US009321558B2

(12) United States Patent
Callahan et al.

(10) Patent No.: US 9,321,558 B2
(45) Date of Patent: Apr. 26, 2016

(54) INSERT ASSEMBLY FOR BEVERAGE CONTAINER

(71) Applicant: Perimeter Brand Packaging, LLC, Northborough, MA (US)

(72) Inventors: Steve Callahan, Westborough, MA (US); David Honan, Concord, MA (US); Shane Yellin, Dover, MA (US); Mark A. Nichols, Newton, MA (US)

(73) Assignee: Perimeter Brand Packaging, LLC, Westborough, MA (US)

( * ) Notice: Subject to any disclaimer, the term of this patent is extended or adjusted under 35 U.S.C. 154(b) by 135 days.

(21) Appl. No.: 14/031,893

(22) Filed: Sep. 19, 2013

(65) Prior Publication Data

US 2014/0376834 A1 Dec. 25, 2014

Related U.S. Application Data

(60) Provisional application No. 61/703,055, filed on Sep. 19, 2012.

(51) Int. Cl.

| | |
|---|---|
| ***B65D 33/02*** | (2006.01) |
| ***B65D 75/52*** | (2006.01) |
| ***B65D 75/58*** | (2006.01) |

(52) U.S. Cl.

CPC ..... *B65D 33/02* (2013.01); *B65D 75/52* (2013.01); *B65D 75/5883* (2013.01)

(58) Field of Classification Search

CPC B65D 21/062; B65D 90/205; B01F 15/0085; B01F 11/0082

USPC ..... 222/105, 230, 459, 464.2, 92; 220/668, 220/9.1, 9.2, 9.4

See application file for complete search history.

(56) References Cited

U.S. PATENT DOCUMENTS

| | | | | |
|---|---|---|---|---|
| 1,428,098 | A * | 9/1922 | James | 190/127 |
| 1,446,400 | A * | 2/1923 | Smith | 220/9.1 |
| 1,927,605 | A * | 9/1933 | Fiore | 222/92 |

(Continued)

FOREIGN PATENT DOCUMENTS

| | | | |
|---|---|---|---|
| FR | 2 841 539 A1 | 1/2004 | B65D 47/22 |
| JP | 2000-103441 | 4/2000 | B65D 33/38 |
| JP | 3159675 B2 | 4/2001 | B65D 33/38 |

OTHER PUBLICATIONS

Steeman, "Self-Heating Packaging for Baby Formula," *Google.com "Best in Packaging"* 8 pages, Feb. 21, 2013.

(Continued)

*Primary Examiner* — Kevin P Shaver
*Assistant Examiner* — Michael J Melaragno
(74) *Attorney, Agent, or Firm* — Sunstein Kann Murphy & Timbers LLP

(57) ABSTRACT

An insert assembly (fitment) includes a container mounting element, a spout element carried by the mounting element, at least one support element and a grasp element suspended by the support element(s) below the mounting element. The grasp element provides a skeleton within a pouch-type flexible container, against which a user can grasp and squeeze the flexible container for mixing or drinking Optionally or alternatively, a mixing element is suspended by the support element(s). The mixing element impinge upon at least a portion of fluid within the container to create turbulence, thereby promoting mixing of powdered material disposed within the container.

19 Claims, 29 Drawing Sheets

(56) References Cited

U.S. PATENT DOCUMENTS

| | | | | | |
|---|---|---|---|---|---|
| 2,200,923 | A * | 5/1940 | Hoggatt | 222/92 |
| 2,596,592 | A * | 5/1952 | Parker | 222/92 |
| 3,061,129 | A * | 10/1962 | Fitzgerald | 215/11.3 |
| 3,490,655 | A * | 1/1970 | Ledgett | 222/196 |
| 3,523,026 | A * | 8/1970 | Emerson et al. | 426/117 |
| 3,523,637 | A * | 8/1970 | Stec | 383/98 |
| 4,138,036 | A * | 2/1979 | Bond | 222/105 |
| 4,322,020 | A * | 3/1982 | Stone | 222/95 |
| 4,440,319 | A * | 4/1984 | Nitchman et al. | 222/131 |
| 4,524,458 | A * | 6/1985 | Pongrass et al. | 383/33 |
| 4,634,028 | A * | 1/1987 | de Larosiere | 222/464.2 |
| 4,637,934 | A * | 1/1987 | White | 426/117 |
| 4,718,778 | A * | 1/1988 | Ichikawa | 383/100 |
| 4,978,025 | A * | 12/1990 | Fougeres | 222/105 |
| 4,998,990 | A * | 3/1991 | Richter et al. | 222/92 |
| 5,139,168 | A * | 8/1992 | Gueret | 222/92 |
| 5,178,021 | A * | 1/1993 | Kosuth | 73/864.62 |
| 5,261,565 | A * | 11/1993 | Drobish et al. | 222/95 |
| 5,647,511 | A * | 7/1997 | Bond | 222/105 |
| 5,660,477 | A * | 8/1997 | Ichikawa | 383/80 |
| 5,730,328 | A * | 3/1998 | Maeder et al. | 222/95 |
| 5,749,493 | A * | 5/1998 | Boone et al. | 222/105 |
| 6,045,006 | A * | 4/2000 | Frazier et al. | 222/105 |
| 6,073,804 | A * | 6/2000 | Yquel | 222/95 |
| 6,105,821 | A * | 8/2000 | Christine et al. | 222/105 |
| 6,190,366 | B1 * | 2/2001 | Tani | 604/279 |
| 6,241,122 | B1 * | 6/2001 | Araki et al. | 222/92 |
| 6,332,564 | B2 * | 12/2001 | Ichikawa | 222/464.1 |
| 6,510,965 | B1 * | 1/2003 | Decottignies et al. | 222/95 |
| 6,652,144 | B2 * | 11/2003 | Stefandl | 383/38 |
| 6,685,691 | B1 * | 2/2004 | Freund et al. | 604/403 |
| 6,860,406 | B2 * | 3/2005 | Kobetsky et al. | 222/92 |
| 6,991,121 | B1 * | 1/2006 | Kipperman et al. | 215/11.1 |
| 7,017,781 | B2 * | 3/2006 | Provenza | 222/105 |
| 7,159,742 | B2 * | 1/2007 | Lee | 222/92 |
| 7,306,095 | B1 * | 12/2007 | Bourque et al. | 206/219 |
| 7,721,759 | B2 * | 5/2010 | Naidu et al. | 137/590 |
| 8,025,182 | B2 * | 9/2011 | Murayama et al. | 222/95 |
| 8,157,130 | B2 * | 4/2012 | Murayama et al. | 222/95 |
| 8,251,971 | B2 * | 8/2012 | Graf et al. | 604/408 |
| 8,282,269 | B2 * | 10/2012 | Terentiev | 366/279 |
| 8,403,236 | B2 * | 3/2013 | Hughes et al. | 239/8 |
| 8,464,908 | B1 * | 6/2013 | Tabor | 222/95 |
| 8,672,182 | B2 * | 3/2014 | Bonet Pedrol | 222/92 |
| 2003/0075560 | A1 * | 4/2003 | Lee | 222/92 |
| 2003/0205583 | A1 * | 11/2003 | Provenza | 222/105 |
| 2004/0050863 | A1 * | 3/2004 | Savage et al. | 222/92 |
| 2004/0084477 | A1 * | 5/2004 | Albaum | 222/95 |
| 2004/0094571 | A1 * | 5/2004 | Rani | 222/92 |
| 2004/0094574 | A1 * | 5/2004 | Sallows et al. | 222/105 |
| 2004/0217126 | A1 * | 11/2004 | Lee | 222/78 |
| 2004/0256410 | A1 * | 12/2004 | Last | 222/92 |
| 2006/0113319 | A1 * | 6/2006 | Smith | 222/105 |
| 2007/0102450 | A1 * | 5/2007 | Stiers | 222/181.1 |
| 2007/0263484 | A1 * | 11/2007 | Terentiev | 366/273 |
| 2008/0314475 | A1 * | 12/2008 | Fransen | 141/20 |
| 2010/0015696 | A1 * | 1/2010 | Claes et al. | 435/303.3 |
| 2010/0089488 | A1 * | 4/2010 | Veenendaal et al. | 141/2 |
| 2011/0174835 | A1 * | 7/2011 | Mamiye | 222/105 |
| 2012/0168461 | A1 * | 7/2012 | Topits et al. | 222/105 |
| 2012/0199614 | A1 * | 8/2012 | Cutting et al. | 222/464.2 |
| 2013/0327790 | A1 * | 12/2013 | Ryan | 222/95 |
| 2014/0312078 | A1 * | 10/2014 | Fitzsimmons et al. | 222/556 |

OTHER PUBLICATIONS

European Patent Office, European Search Report, Application No. EP 14 18 4376, 4 pages, dated Feb. 25, 2015.

* cited by examiner

INSERT ASSEMBLY FOR BEVERAGE CONTAINER

CROSS REFERENCE TO RELATED APPLICATIONS

This application claims the benefit of U.S. Provisional Patent Application No. 61/703,055, filed Sep. 19, 2012, titled "Insert Assembly for Beverage Container," the entire contents of which are hereby incorporated by reference herein, for all purposes.

TECHNICAL FIELD

The present invention relates to pouch-type flexible beverage containers ("pouches") and, more particularly, to internal structures for such beverage containers to prevent collapse of the containers when grasped and/or to facilitate mixing ingredients within the containers.

BACKGROUND ART

Liquids, such as beverages, detergents and pesticides, as well as many other liquids requiring airtight seals are packaged and contained in pouch-type containers. These containers typically include coverings or caps removably attached to opening portions, such as spouts, of the containers. A user can remove the cap from a container to access liquid contained therein and subsequently replace and reseal the cap to the container to maintain freshness of remaining liquid.

Protein powder and other supplement drinks are popular among bodybuilders and other exercise enthusiasts. Typically, supplement powder and a liquid, such as water or milk, are mixed in a blender and then poured into a container for consumption, or the power and liquid are mixed within the container by shaking the container. Some supplement drink consumers prefer to consume such drinks within certain timeframes, such as within 60 minutes (a so-called "golden window") after exercising.

Many consumers prefer to keep supplement powder dry until they are ready to consume it. Thus, such consumers prefer to mix dry supplement powder with liquid just before they wish to drink the mixture. Several factors motivate delaying the addition of the liquid until just before the supplement is to be consumed. For example, cold liquid may be added to the powder, whereas a pre-mixed drink is likely to have warmed to an unappetizing temperature by the time a consumer is ready to drink it. Furthermore, pouches of dry powder are much lighter and less bulky than pouches that contain powder and liquid. In addition, some health-conscience consumers prefer not to purchase pre-mixed drinks, because pre-mixed drinks typically contain preservatives, and these consumers prefer to avoid these preservatives.

Although some consumers purchase supplement powder in large, multi-serving containers and scoop a single serving quantity into their own beverage containers when needed, other consumers prefer to purchase single-serving pouch-type beverage containers that are pre-filled with dry supplement powder and add liquid just before consuming a drink. In either case, the supplement powder needs to be mixed with the liquid. However, most supplements do not mix well with water. For example, some supplements tend to clump, foam or fizz. Milk avoids most of the mixing problems. However, many consumers prefer to avoid calories that would be provided by the milk.

Although pouch-type beverage containers have several advantages over rigid containers, pouch-type beverage containers become difficult to drink from as they become less than full. The pouch collapses, leaving little or nothing to solidly grasp, thereby making the containers awkward to drink from and difficult to shake, so as to mix supplement that has settled after an initial mixing. Furthermore, as the pouch collapses, it traps supplement in interior crevices and pockets and clinging to interior walls of the container. In some cases, a less-than-full pouch folds or flops, making it difficult to access some of the contents.

SUMMARY OF EMBODIMENTS

An embodiment of the present invention provides a fitment for a flexible container. The flexible container has walls and defines an opening. The fitment includes a mounting structure, a spout coupled to the mounting structure, at least one support structure extending from the mounting structure and a grasp structure. The mounting structure is configured to be sealingly coupled to the flexible container about the opening, thereby defining an interior of the flexible container. The spout defines a fluid channel through the mounting structure. The spout is configured to be in fluid communication with the interior of the flexible container. The at least one support structure extends from the mounting structure, generally parallel to an axis extending through the fluid channel of the spout. The at least one support structure is configured to extend into the interior of the flexible container. The grasp structure extends along a loop in a plane generally perpendicular to the axis passing through the fluid channel of the spout. The grasp structure is attached to each of the at least one support structure. The grasp structure is configured to be inserted into the interior of the flexible container and there extend proximate an inside perimeter of the flexible container. The grasp structure provides a skeletal structure against which the walls of the flexible container may be pressed when the flexible container is grasped.

The fitment may also include a first spacing member extending from a first point along the grasp structure to an approximately diametrically opposite point along the grasp structure. The first spacing member is not directly attached to the mounting structure.

The first spacing member may extend generally along an arc in a plane generally perpendicular to the plane of the loop.

The fitment may also include a first pad and a second pad. The first pad may be attached to the grasp structure proximate the first point along the grasp structure. The first pad may be oriented generally parallel to the axis passing through the fluid channel of the spout. The second pad may be generally parallel to the first pad. The second pad may be attached to the grasp structure proximate the diametrically opposite point along the grasp structure.

The at least one support structure may include at least a first support structure and a second support structure. The first support structure may be attached to the grasp structure approximately equidistantly between the first point along the grasp structure and the diametrically opposite point along the grasp structure. The second support structure may be attached to the grasp structure approximately diametrically opposite the first support structure.

The fitment may also include a second spacing member extending from where the first support structure is attached to the grasp structure to where the second support structure is attached to the grasp structure. The second spacing member is not directly attached to the mounting structure.

The second spacing member may extend generally along an arc in a plane generally perpendicular to the plane of the first spacing member.

Each of the first support structure and the second support structure may define an outwardly-facing concave portion proximate where the respective support structure is attached to the grasp structure.

The fitment may also include a mixing structure. The mixing structure may be mechanically coupled to the first support structure, the second support structure and the grasp structure. The mixing structure may be configured to extend into the interior of the flexible container. The mixing structure may be disposed so as to promote mixing of contents in the interior of the flexible container. The mixing structure may be disposed so as to interfere with smooth flow of fluid introduced through the spout in a direction toward the interior of the flexible container.

The grasp structure may extend along a generally oval-shaped loop having a major diameter at least about 1½ times as long as a minor diameter of the generally oval-shaped loop.

The flexible container may have a predetermined internal depth. The mounting structure, the at least one support structure and the grasp structure may be configured such that the grasp structure is spaced from the mounting structure along the axis of the fluid channel of the spout a distance of between about ¼ and about ¾ the internal depth of the flexible container.

The flexible container may define a waist portion located a predetermined distance from the opening of the flexible container. The mounting structure, the at least one support structure and the grasp structure may be configured such that the grasp structure is spaced from the mounting structure along the axis of the fluid channel of the spout a distance approximately equal to the predetermined distance.

The fitment may be attached to the flexible container.

The fitment may include a mixing structure. The mixing structure may be mechanically coupled to the mounting structure. The mixing structure may be configured to be disposed in the interior of the flexible container. The mixing structure may be disposed so as to promote mixing of contents in the interior of the flexible container. The mixing structure may be disposed so as to interfere with smooth flow of fluid introduced through the spout in a direction toward the interior of the flexible container.

The mixing structure may include a plurality of interconnected members collectively defining a plurality of apertures through the mixing structure.

An embodiment of the present invention provides a fitment for a flexible container. The flexible container has walls and defines an opening. The fitment includes a mounting structure, a spout coupled to the mounting structure, at least one support structure extending from the mounting structure and a mixing structure attached to the at least one support structure. The mounting structure is configured to be sealingly coupled to the flexible container about the opening, thereby defining an interior of the flexible container. The spout defines a fluid channel through the mounting structure. The spout is configured to be in fluid communication with the interior of the flexible container. The at least one support structure extending from the mounting structure, generally parallel to an axis extending through the fluid channel of the spout. The at least one support structure is configured to extend into the interior of the flexible container. The mixing structure is configured to be disposed in the interior of the flexible container. The mixing structure is disposed so as to promote mixing of contents in the interior of the flexible container. The mixing structure is disposed so as to interfere with smooth flow of fluid introduced through the spout in a direction toward the interior of the flexible container.

The mixing structure may include a plurality of interconnected members collectively defining a plurality of apertures through the mixing structure.

The flexible container may have a predetermined internal depth. The mounting structure, the at least one support structure and the mixing structure may be configured such that the mixing structure is spaced from the mounting structure along the axis of the fluid channel of the spout a distance of between about ¼ and about ¾ the internal depth of the flexible container.

The flexible container may define a waist portion located a predetermined distance from the opening of the flexible container. The mounting structure, the at least one support structure and the mixing structure may be configured such that the mixing structure is spaced from the mounting structure along the axis of the fluid channel of the spout a distance approximately equal to the predetermined distance.

The fitment may be attached to the flexible container.

Yet another embodiment of the present invention provides a container assembly. The container assembly includes a container and an insert assembly coupled to the container. The insert assembly includes a mounting element, a spout element extending from the mounting element and a flow-through structure extending from the mounting element. The flow-through element is disposed in fluid communication with the spout element. The flow-through element is configured to promote mixing of contents in the interior of the container. The flow-through element is configured to impinge upon at least a portion of a flow of fluid received from the spout to create turbulence within the flow of fluid.

BRIEF DESCRIPTION OF THE DRAWINGS

The invention will be more fully understood by referring to the following Detailed Description of Specific Embodiments in conjunction with the Drawings. The drawings are not necessarily to scale, emphasis instead being placed upon illustrating principles of various embodiments of the innovation.

DETAILED DESCRIPTION OF SPECIFIC EMBODIMENTS

Embodiments of the present invention address problems associated with grasping pouch-type containers and mixing contents of such containers. Embodiments of the present invention include fitments configured for insertion into pouch-type flexible containers and associated flexible containers.

In some embodiments, the fitment includes a skeleton (also referred to herein as a grasp structure) within the pouch, against which flexible walls of the container can be pressed when a user grasps the outside of the pouch. The skeleton provides a structure against which the user can apply grasping force, thereby preventing significant collapse of the pouch. In some embodiments, the fitment includes structures that are spaced apart a distance approximately equal to an inside dimension of the pouch. The structures are configured to resist deflection toward each other.

In some embodiments, the fitment includes a mixing structure that resides within the pouch and facilitates mixing contents, such as powders and liquids, in the pouch. The mixing structure interferes with smooth flow of the contents within the container, such as when the container is shaken or liquid is added to the container, thereby breaking up clumps of the powder and often creating turbulence in the liquid, which enhances mixing. The mixing structure does not, however, completely prevent flow of the contents within the container.

Flexible Container

Figure 2:
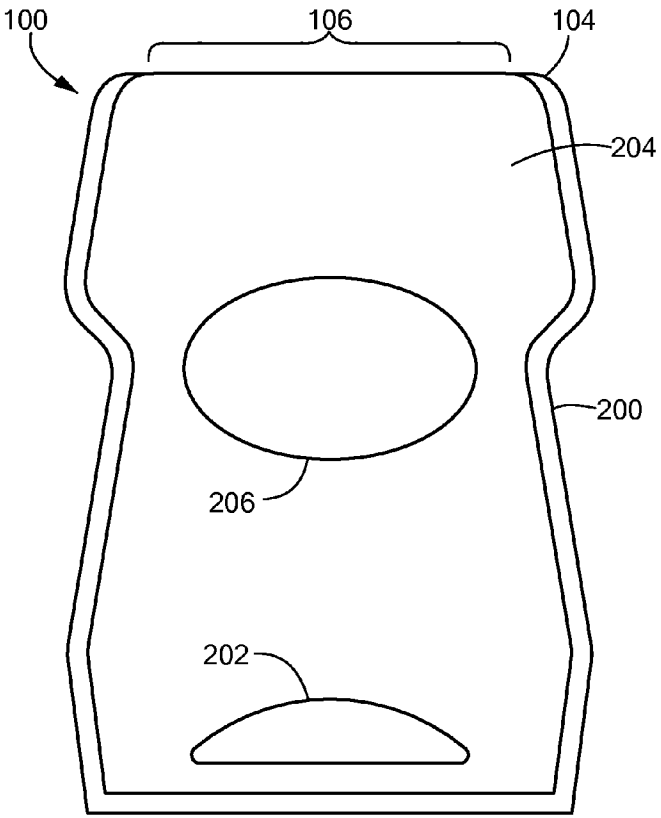
FIG. 2 is a rear view of the flexible container of FIG. 1.
Figure 1:
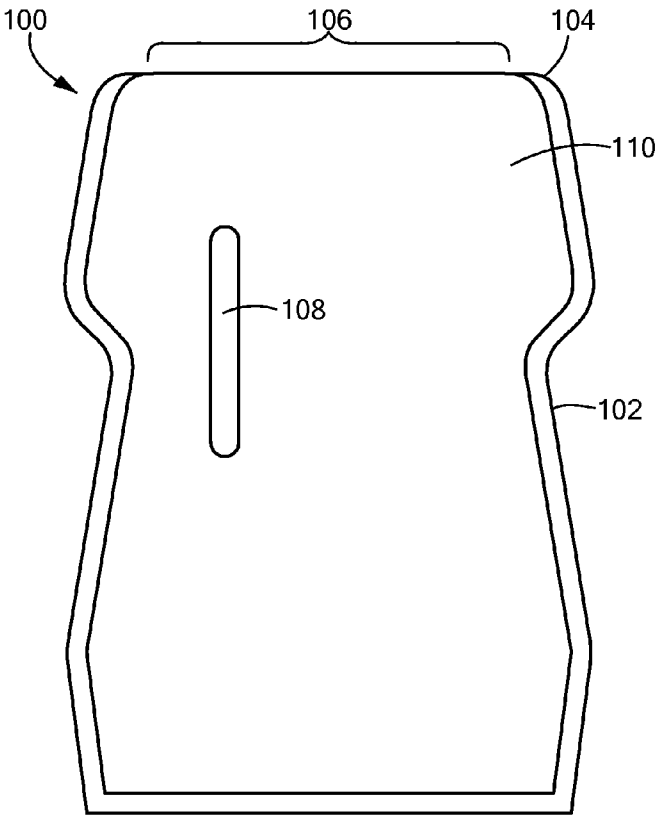
FIG. 1 is a front view of a flexible container, according to an embodiment of the present invention.

FIG. 1 is a front view of a pouch-type flexible container 100, and FIG. 2 is a back view of the flexible container 100. The flexible container 100 includes two flexible walls 102 and 200 that are welded or otherwise joined together along a portion 104 of the perimeter of the two walls 102 and 200. The walls 102 and 200 may be made of a flexible material, such as thin plastic film, and the walls 102 and 200 may be ultrasonically welded together, joined by an adhesive or otherwise joined, as is well known in the art. An unjoined portion 106 defines an opening into an interior of the flexible container 100. The flexible container 100 may be configured as a single-serving pouch or as a multiple-serving pouch.

Figure 3:
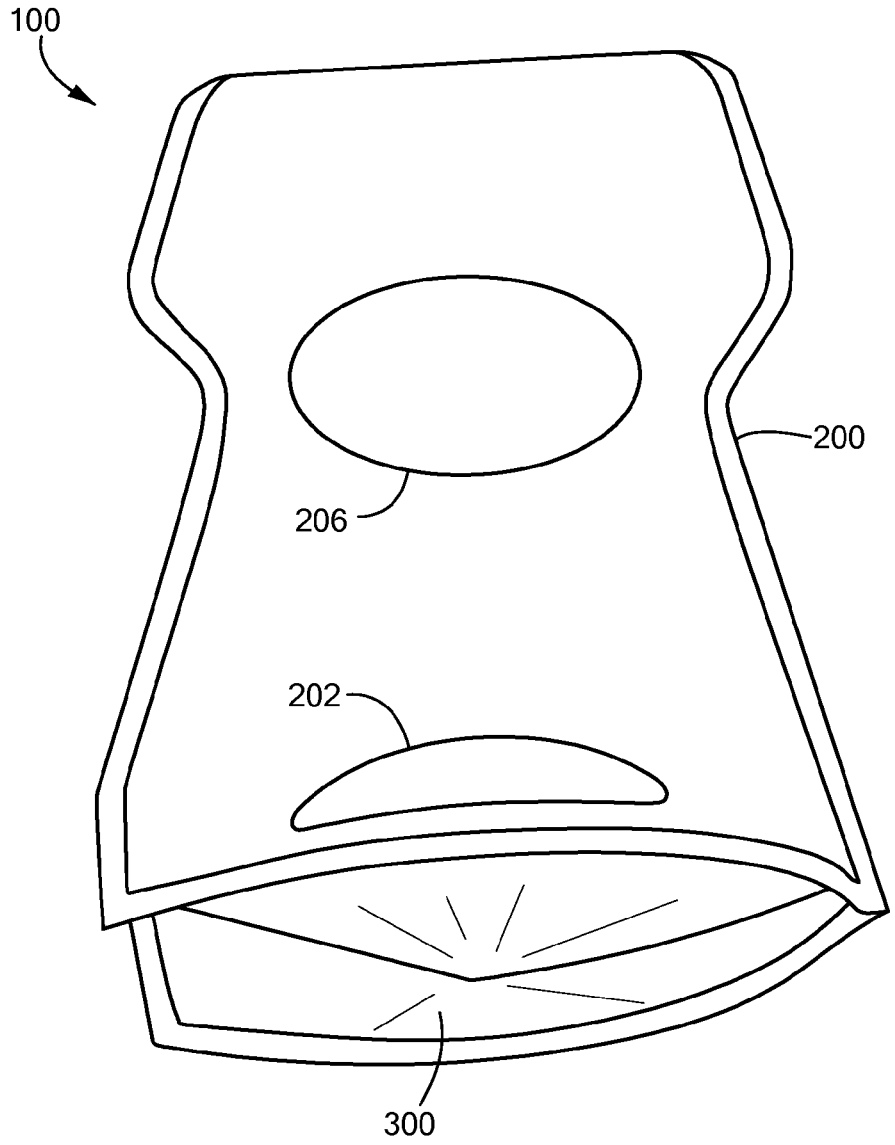
FIG. 3 is a perspective view of the flexible container of FIGS. 1 and 2.

FIG. 3 is a perspective view of the flexible container 100. In some embodiments, as shown in FIG. 3, the flexible container 100 includes a gusseted bottom portion 300.

Returning to FIG. 1, the front wall 102 includes an elongated transparent gauge 108, by which a user may ascertain fullness of the flexible container 100. The transparent gauge 108 is surrounded by an opaque or translucent region 110 that defines the elongated transparent gauge 108. The opaque or translucent region 110 may extend over the rest of the front wall 102, or it may extend over only a portion of the rest of the front wall 102, as a matter of design choice.

As shown in FIG. 2, the back wall 200 includes a transparent window 202 proximate a bottom of the back wall 200, through which a user may observe contents at the bottom of the container 100. The transparent window 202 is surrounded by an opaque or translucent region 204 that defines the transparent window 202. The window 202 facilitates ascertaining whether the flexible container 100 contains a power and general appearance of the powder, such as color of the powder and whether the powder has been sufficiently mixed with liquid. The back wall 200 also includes a generally oval shaped window 206, the purpose of which will be described below. The opaque or translucent region 204 may extend over the rest of the back wall 200, or it may extend over only a portion of the rest of the back wall 200, as a matter of design choice

Fitment for Flexible Container

Grasp Structure

Figure 4:
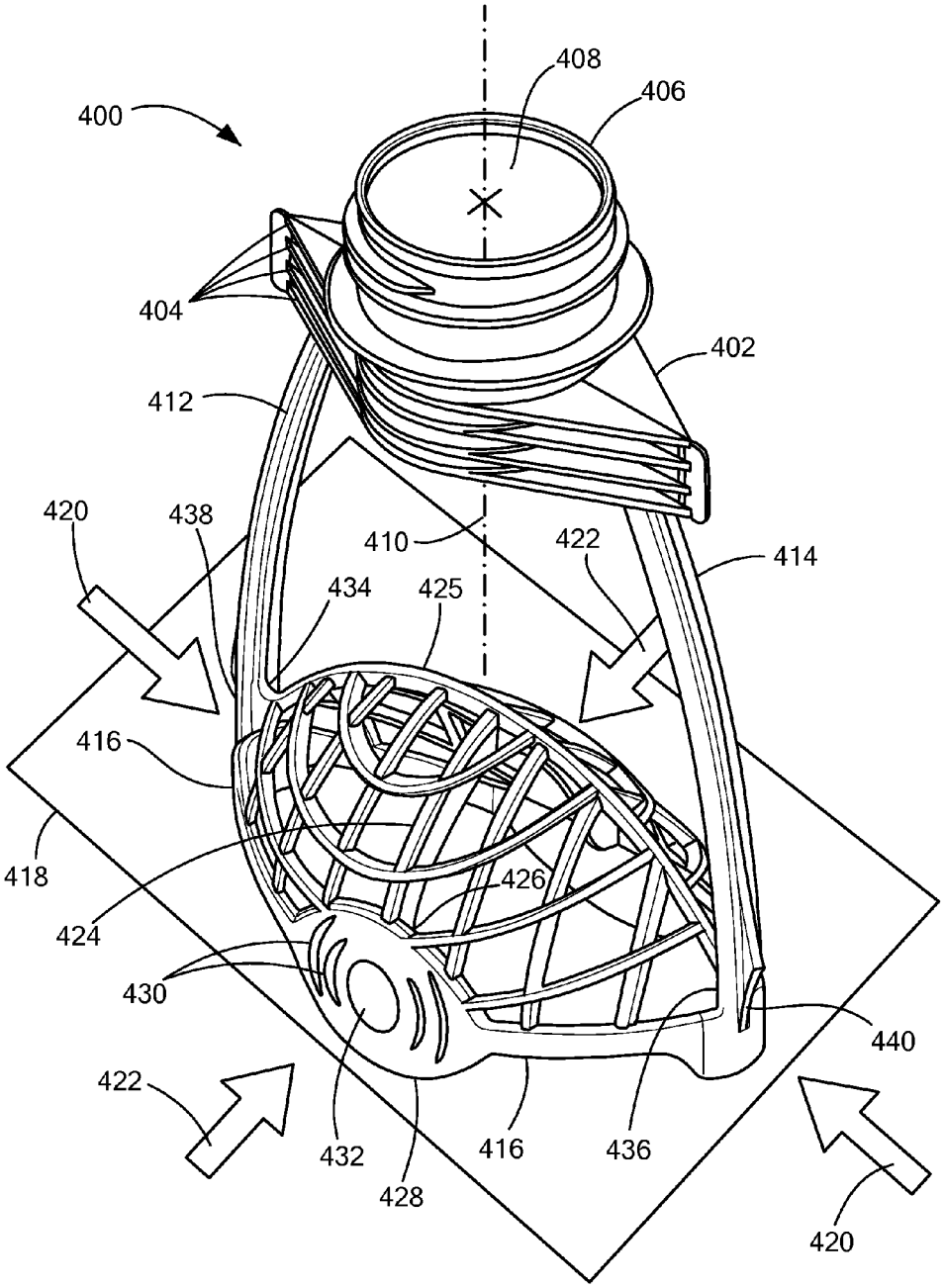
FIG. 4 is a perspective view of a fitment for the flexible container of FIGS. 1-3, according to an embodiment of the present invention.
Figure 5:
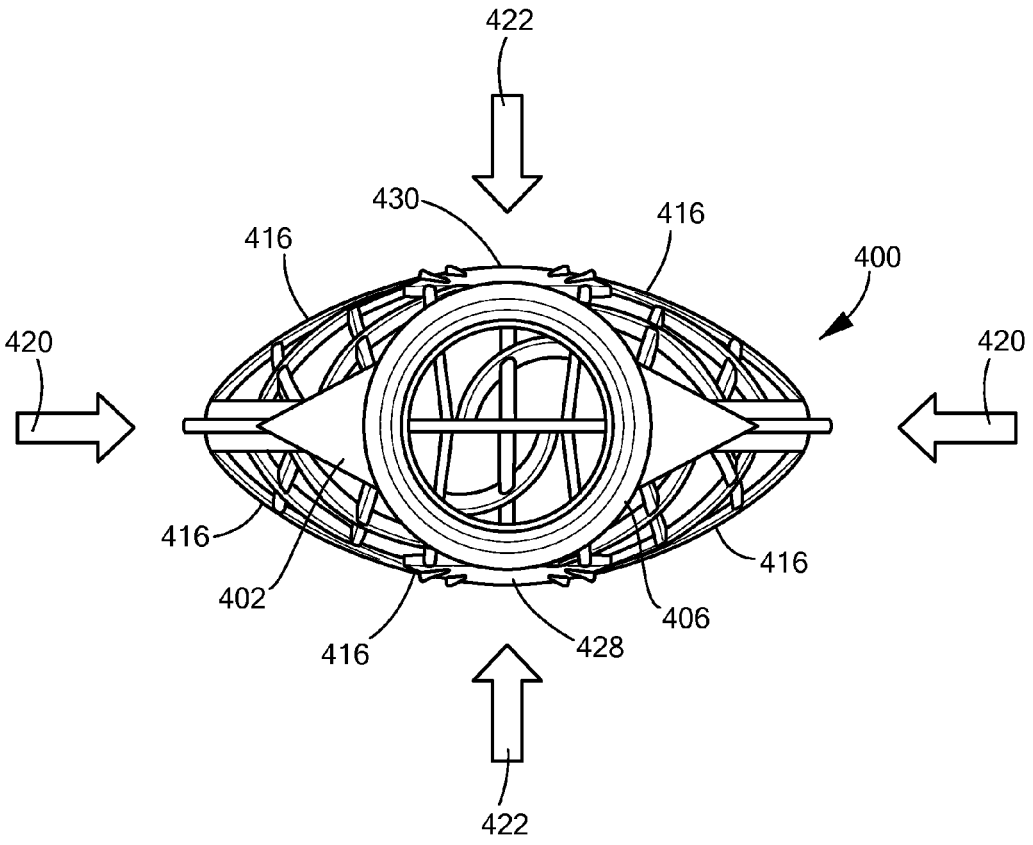
FIGS. 5, 6 and 7 are respective top, front and side views of the fitment of FIG. 4.
Figure 7:
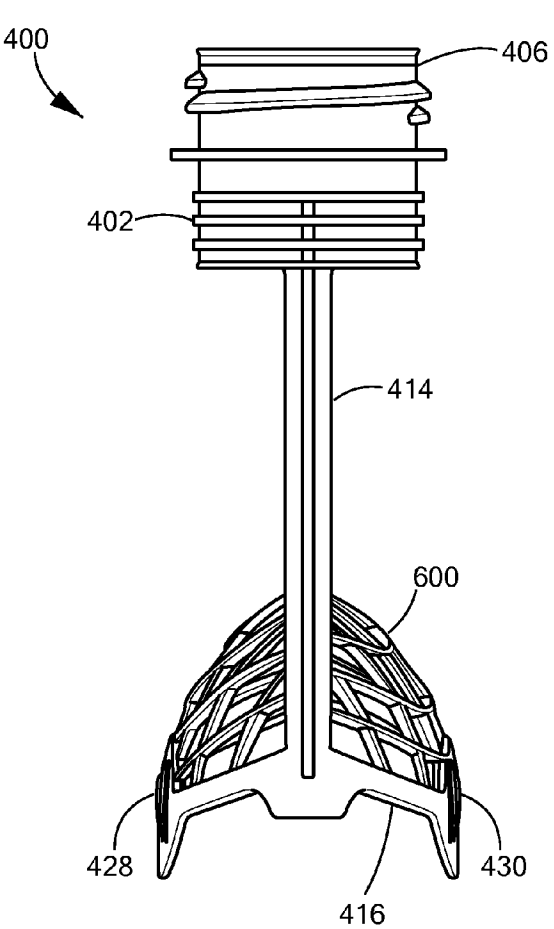
Figure 6:
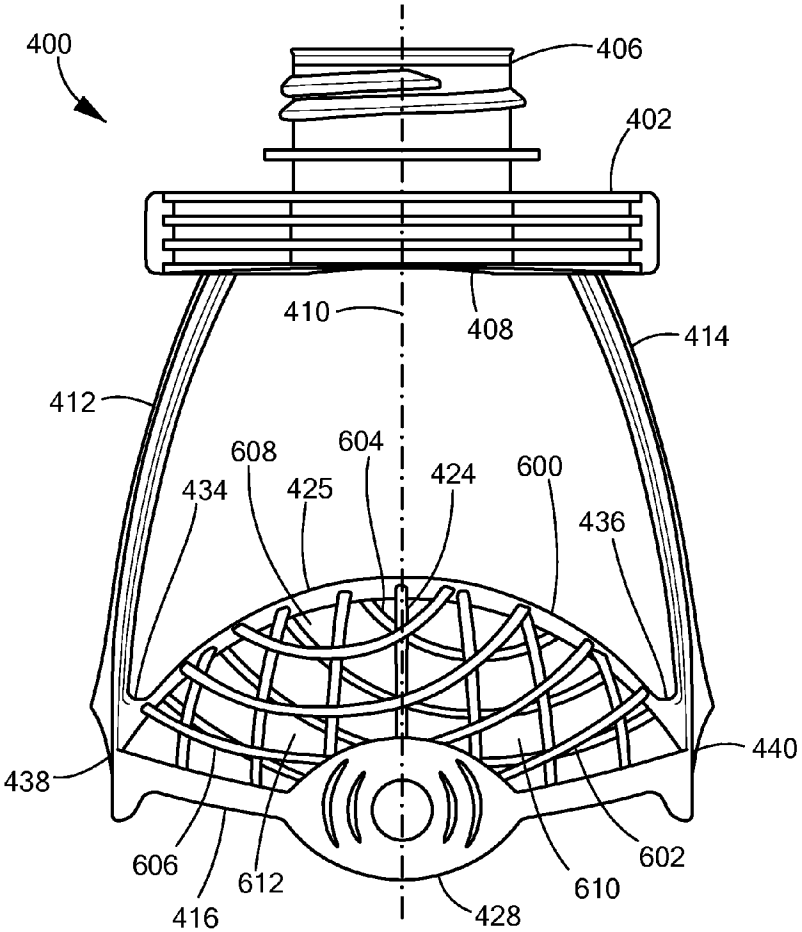
Figure 8:
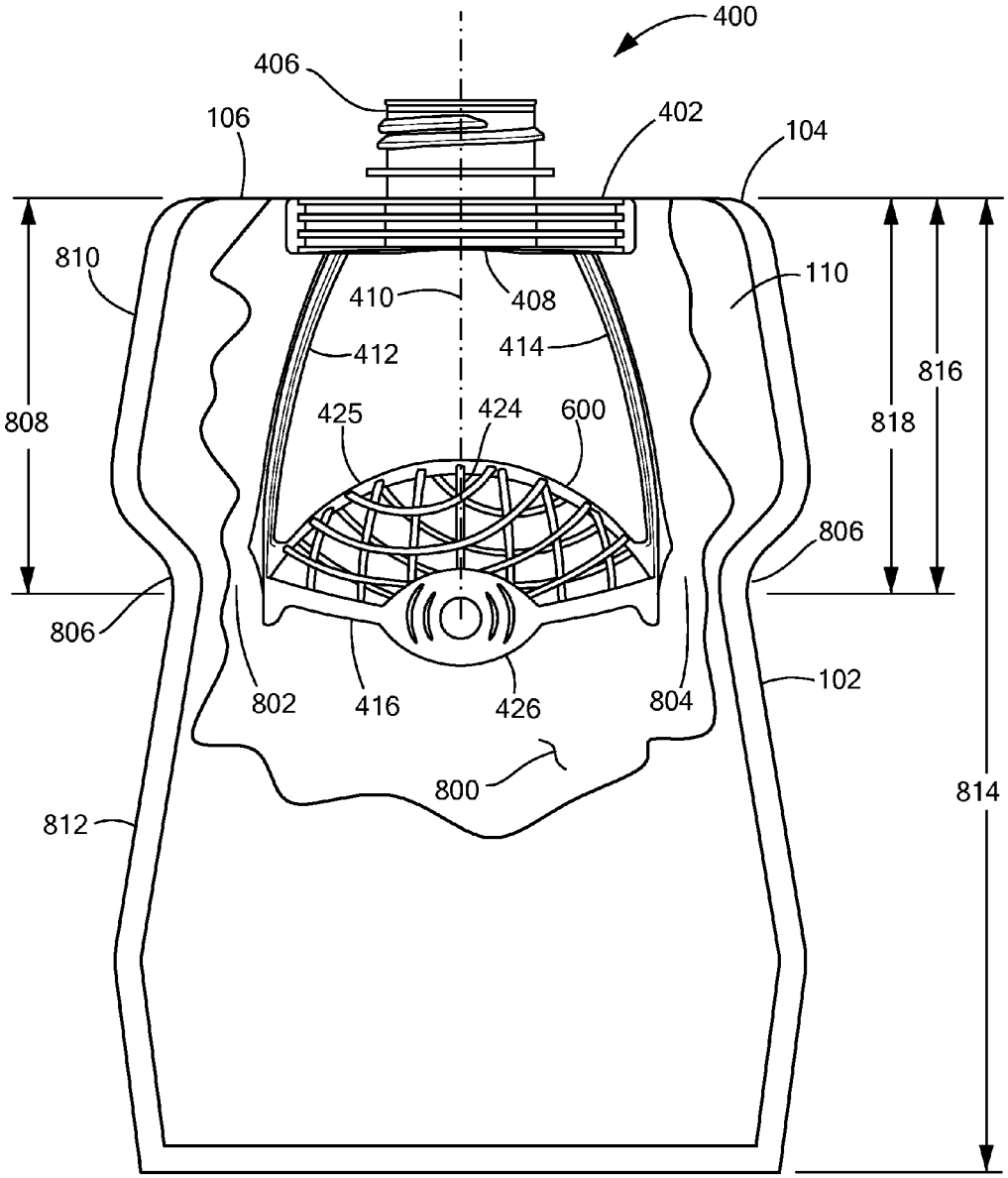
FIG. 8 is a cut-away front view of the flexible container of FIGS. 1-3, with the fitment of FIGS. 4-7 installed therein, according to an embodiment of the present invention.

FIG. 4 is a perspective view of a fitment 400 (also referred to herein as an "insert assembly") for the flexible container 100. FIGS. 5, 6 and 7 are respective top, front and side views of the fitment 400. The fitment 400 includes a generally canoe-shaped mounting structure 402, which includes a plurality of ribs 404. Each rib 404 defines a bonding surface for sealingly bonding the fitment 400 to the interior of the flexible container 100, about the opening 106 in the flexible container 100, in a well-known manner. FIG. 8 is a front cut-away view of the fitment 400 installed in the flexible container 100.

A spout 406 is coupled to the mounting structure 402. The spout 406 may be threaded to accept a complementarily threaded cap (not shown). The spout 406 defines a fluid channel 408 through the mounting structure 402 and into an interior 800 of the flexible container 100. Thus, the spout 406 is in fluid communication with the interior 800 of the flexible container 100. An axis 410 extends through the fluid channel 408 of the spout 406.

Two support structures 412 and 414 extend below the mounting structure 402, generally parallel to the axis 410. As can be seen in FIG. 8, the support structures 412 and 414 extend into the interior 800 of the flexible container 100, when the fitment 400 is installed in the flexible container 100.

The fitment 400 includes a grasp structure 416, best seen in FIGS. 4 and 5. The grasp structure 416 extends along a loop, i.e., along a closed curve whose initial and final points coincide in a fixed point. In some embodiments, the loop is generally oral shaped. In some embodiments, the loop has a major diameter at least about 1½ times as long as a minor diameter of the loop. Four portions of the looped grasp structure are identified by reference numerals 416 in FIG. 5. The loop lies generally in a plane 418 (FIG. 4) that is generally perpendicular to the axis 410, although the loop may include relatively minor undulations out of the plane 418.

The grasp structure 416 is attached to each of the support structures 412 and 414. When the fitment 400 is installed in the flexible container 100, the grasp structure 416 extends proximate an inside perimeter of the flexible container, for example as indicated at 802 and 804 (FIG. 8). The grasp structure 416 and, in some embodiments, the support structures 412 and 414 provide a skeletal structure against which the walls 102 and 200 may be pressed when a user grasps and squeezes or shakes the flexible container 100.

For example, the flexible container 100 may define a waist portion 806 located a predetermined distance 808 from the opening 106 of the flexible container 100. The waist portion 806 is narrower than vertically adjacent portions of the flexible container 100. The mounting structure 402, the support structures 412 and 414 and the grasp structure 416 are configured such that the grasp structure 416 is spaced from the mounting structure 402 along the axis 410 a distance approximately equal to the distance 808. Consequently, the vertical position of the grasp structure 416 approximately corresponds with the vertical position of the waist portion 806. This positioning allows the flexible container 100 to have portions ("shoulders" 810 and "hips" 812) that are larger, and therefore have greater capacities, than the waist portion 806.

Although the flexible container 100, with the fitment 400 installed, may be grasped anywhere, the flexible container 100 exhibits better grasping performance, i.e., the walls 102 and 200 collapse less, when a user grasps the flexible container 100 about the waist portion 806. Typically, a user grasps the flexible container 100 across the major diameter of the grasp structure 416, as indicated schematically by arrows 420 (FIGS. 4 and 5), or across the minor diameter of the grasp structure 416, as indicated schematically by arrows 422.

The grasp structure 416 is relatively stiff, although it may resiliently deflect somewhat inward under urging of a user's grip. The grasp structure 416 may be dimensioned and/or made of a material selected to minimize or control the amount of deflection experienced by the grasp structure 416 or the amount of force required to deflect the grasp structure 416 when a user grasps the flexible container 100.

A first spacing member 424 (best seen in FIG. 4) may extend from a first point 426 along the grasp structure 416 to an approximately diametrically opposite point (not visible) along the grasp structure 416. For example, the first spacing member 424 may extend across a minor diameter of the grasp structure 416. The first spacing member 424 stiffens the grasp structure 416 along the minor diameter of the grasp structure 416. The first spacing member 424 may be dimensioned and/or made of a suitable material selected to minimize or control the amount of deflection experienced by the grasp structure 416 when a user grasps the flexible container 100.

The first spacing member 424 may be straight or, as shown in FIG. 4, the first spacing member 424 may extend generally along an arc in a plane generally perpendicular to the plane 418 of the loop 416. As can be seen in FIG. 7, the arc of the first spacing member 424 is not necessarily a smooth arc, i.e., the arc may include a point, such as at the top of the arc, where two smooth arcs join. The first spacing member 424 is not directly attached to the mounting structure 402. However, the first spacing member 424 is indirectly attached to the mounting structure 402, i.e., via the grasp structure 416 and the support structures 412 and 414.

To provide tactile feedback and a surer grip, two pads 428 and 430 may be attached to the grasp structure 416 at the two points 426 (and not visible) where the spacing member 424 is attached to the grasp structure 416. The pads 428 and 430 may be oriented generally parallel to the axis 410 and, more specifically, parallel to the walls 102 and 200 of the flexible container 100. The two pads 428 and 430 may be generally parallel to each other. Each pad 428 and 430 may include raised features 430 and/or a depression 432 for tactile feedback and better grip.

The support structures 412 and 414 may be attached to the grasp structure 416 at two respective points 434 and 436 (best seen in FIG. 6) located on the grasp structure 416 approximately equidistantly between the two points 426 (and not visible) where the spacing member 424 attaches to the grasp structure 416.

Each support structure 412 and 414 may define an outwardly-facing concave portion 438 and 440 (best seen in FIG. 6). These concave portions 438 and 440 provide tactile feedback and surer grip.

A second spacing member 425 (best seen in FIG. 4) may extend from where the first support structure 412 is attached to the grasp structure 416 to where the second support structure 414 is attached to the grasp structure 416. For example, the second spacing member 425 may extend from the point 434 on the grasp structure 416 to the point 436 on the grasp structure 416. The points where the second spacing member 425 attaches may be approximately diametrically opposite each other, with respect to the loop of the grasp structure 416. The second spacing member 425 stiffens the grasp structure 416 along the major diameter of the grasp structure 416. The second spacing member 425 may be dimensioned and/or made of a suitable material selected to minimize or control the amount of deflection experienced by the grasp structure 416 when a user grasps the flexible container 100.

The second spacing member 425 may be straight or, as shown in FIGS. 4 and 8, the second spacing member 425 may extend generally along an arc in a plane generally perpendicular to the plane 418 of the loop 416. As can be seen in FIG. 8, the arc of the second spacing member 425 may be smooth. However, in other embodiments, the arc may not necessarily be smooth, i.e., the arc may include a point, such as at the top of the arc, where two smooth arcs join. The second spacing member 425 is not directly attached to the mounting structure 402. However, the second spacing member 425 is indirectly attached to the mounting structure 402, i.e., via the support structures 412 and 414 and optionally via the grip structure 416.

The flexible container 100 may have a predetermined internal depth 814 (FIG. 8). The mounting structure 402, the support structures 412 and 414 and the grasp structure 416 may be configured such that, when the fitment 100 is installed in the flexible container 100, the grasp structure 416 is spaced from the mounting structure 402 along the axis 410 a distance 816 that is between about ¼ and ¾ the internal depth 814 of the flexible container 100. In some embodiments, the distance 816 is about ⅓ of the internal depth 814. The distance 816 may be approximately equal to the distance 808 the waist portion 806 is located below the top of the flexible container 100.

The fitment 400 may be molded of a polymeric or other suitable material or fabricated by another suitable process. Exemplary polymeric materials include polypropylene, polystyrene, polystyrene-acrylonitrile, acrylonitrile-butadiene-styrene, styrene-maleic anhydride, polycarbonate, polyethylene terephthalate, polyvinyl cyclohexane and blends thereof.

Fitment for Flexible Container

Mixing Structure

Some embodiments of the fitment 400 include a mixing structure, with or without a grasp structure 416. This description is of a fitment 400 that includes a grasp structure 416 and a mixing structure. However, other embodiments may omit the grasp structure 416. Similarly, some embodiments include a grasp structure 416, without a mixing structure.

A mixing structure 600 (best seen in FIG. 6) includes a plurality of members, exemplified by members 602, 604 and 606, that are interconnected and collectively define a plurality of apertures, exemplified by apertures 608, 610 and 612, through the mixing structure 600. In the embodiment illustrated in FIGS. 4-8, the mixing structure 600 resembles an open-weave basket with generally rectangular apertures 608-612, however other shaped members and other shaped apertures may be used. The members 602-606 act to break up clumps of powder, when fluid is introduced into the flexible container 100 or the container 100 is shaken.

The first and second spacing members 424 and 425 may, but need not, be parts of the mixing structure 600. In the embodiment shown in FIGS. 4-8, the first and second spacing members 424 and 425 are parts of the mixing structure 600. Thus, material used to make up the first and second spacing members 424 and 425 and cost of the material is amortized across both the spacing members 424 and 425 and the mixing structure 600.

The mixing structure 600 is mechanically coupled to the mounting structure 402 by the support structures 412 and 414. The mixing structure 600 is configured to be disposed in the interior of the flexible container 100, as shown in FIG. 8. The mixing structure 600 is disposed, relative to the mounting structure 402, so as to interfere with smooth flow of fluid introduced through the spout 406 in a direction toward the interior 800 of the flexible container 100. For example, as a stream of fluid is introduced through the spout 406, at least a portion of the stream comes into contact with the members 602-606 of the mixing structure 600, creating turbulence in the stream, thereby promoting mixing of the fluid with powder in the flexible container 100.

As noted, the flexible container 100 may have a predetermined internal depth 814 (FIG. 8). The mounting structure 402, the support structures 412 and 414 and the mixing structure 600 may be configured such that, when the fitment 100 is installed in the flexible container 100, the mixing structure 600 is spaced from the mounting structure 402 along the axis 410 a distance 818 that is between about ¼ and ¾ the internal depth 814 of the flexible container 100. In some embodiments, the distance 818 is about ⅓ of the internal depth 814. The distance 818 may be approximately equal to the distance 808 the waist portion 806 is located below the top of the flexible container 100.

As noted, the back wall 200 (FIG. 2) of the flexible container 100 defines a generally oval window 206. The window 206 is sized and located on the back wall 200 to generally coincide with the size and location of the mixing structure 600. Thus, a user can see the mixing structure 600 and ascertain whether a significant amount of powder is adhered to the mixing structure 600. If so, the user may further shake the flexible container 100 to dissolve the adhered powder or disperse it into suspension in the fluid in the flexible container 100.

The pads 428 and 430 (FIGS. 5 and 7) may also be visible through the window 206. In some embodiments, the concave portions 438 and 440 of the support structures 412 and 414 are also visible through the window 206. These visibilities provide visual cues to a user where and how to grasp the flexible container 100.

As can be seen in FIG. 8, the mounting structure 402, the support structures 412 and 414 and the mixing structure 600 are configured such that the mixing structure 600 is spaced from the mounting structure 402 along the axis 410 a distance approximately equal to the distance 808. Consequently, the vertical position of the mixing structure 800 approximately corresponds with the vertical position of the waist portion 806 of the flexible container 100.

Other Embodiments

Figure 9:
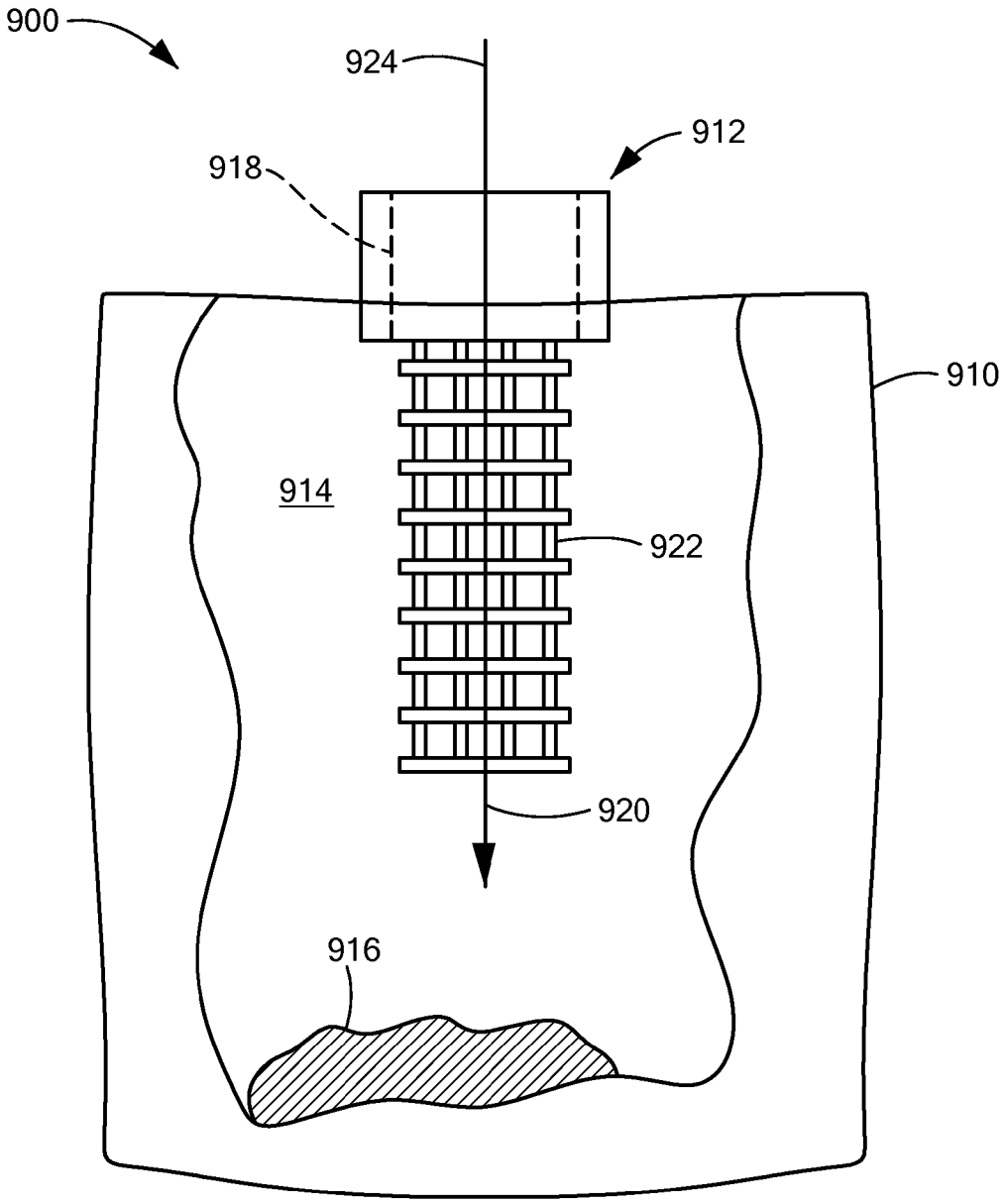
FIG. 9 is a cut-away view of a container having an insert assembly, according to another embodiment of the present invention.

FIG. 9 illustrates, in partial sectional view, a container assembly 900, according to one embodiment. The container assembly 900 includes a container 910 and an insert assembly or fitment 912 configured to provide both fluid entry and fluid removal from the container 910. For example, the container 910 can be configured as a single serving pouch defining an internal volume 914 that contains a powdered material 916, such as a powdered drink concentrate or a protein powder. The insert assembly 912 defines a single opening 18 that provides fluid communication between the internal volume 914 and the outside of the container 910 for both addition and removal of fluid relative to the container 910. While the opening 918 defined by the insert assembly 912 can be configured in a variety of ways, in one arrangement, the opening 918 is sized and shaped to receive fluid 920, such as water from an external source, and to direct the fluid to the powdered material 916 contained within the internal volume 914.

The insert assembly 912 is also configured to agitate the fluid 920 as it enters the container 910, thereby causing the fluid 920 and the powdered material 916 to mix with each other. For example, the insert assembly 912 includes a flow-through structure 922 extending into the internal volume 914 of the container 910 and substantially aligned with a longitudinal axis 924 of the insert assembly 912. As a user adds fluid 920, such as water, to the container 910 via the opening 918, the fluid 920 flows through and/or past the flow-through structure 922 which, in turn, agitates or induces turbulent flow in the fluid 920. As the turbulent fluid exits the flow-through structure 922, the fluid 920 mixes with the powdered material 916 contained within the internal volume 914. Once mixed, the user can then drink the mixture from the container 910 via the insert assembly 912.

While the insert assembly 912 can be manufactured in a variety of ways utilizing a variety of materials, in one embodiment, a manufacturer injection molds the insert assembly 912 from a suitable plastic material. The manufacturer can then secure the insert assembly 912 to the container 910 utilizing a variety of fixation materials and methods, as are well known in the art.

Figure 10:
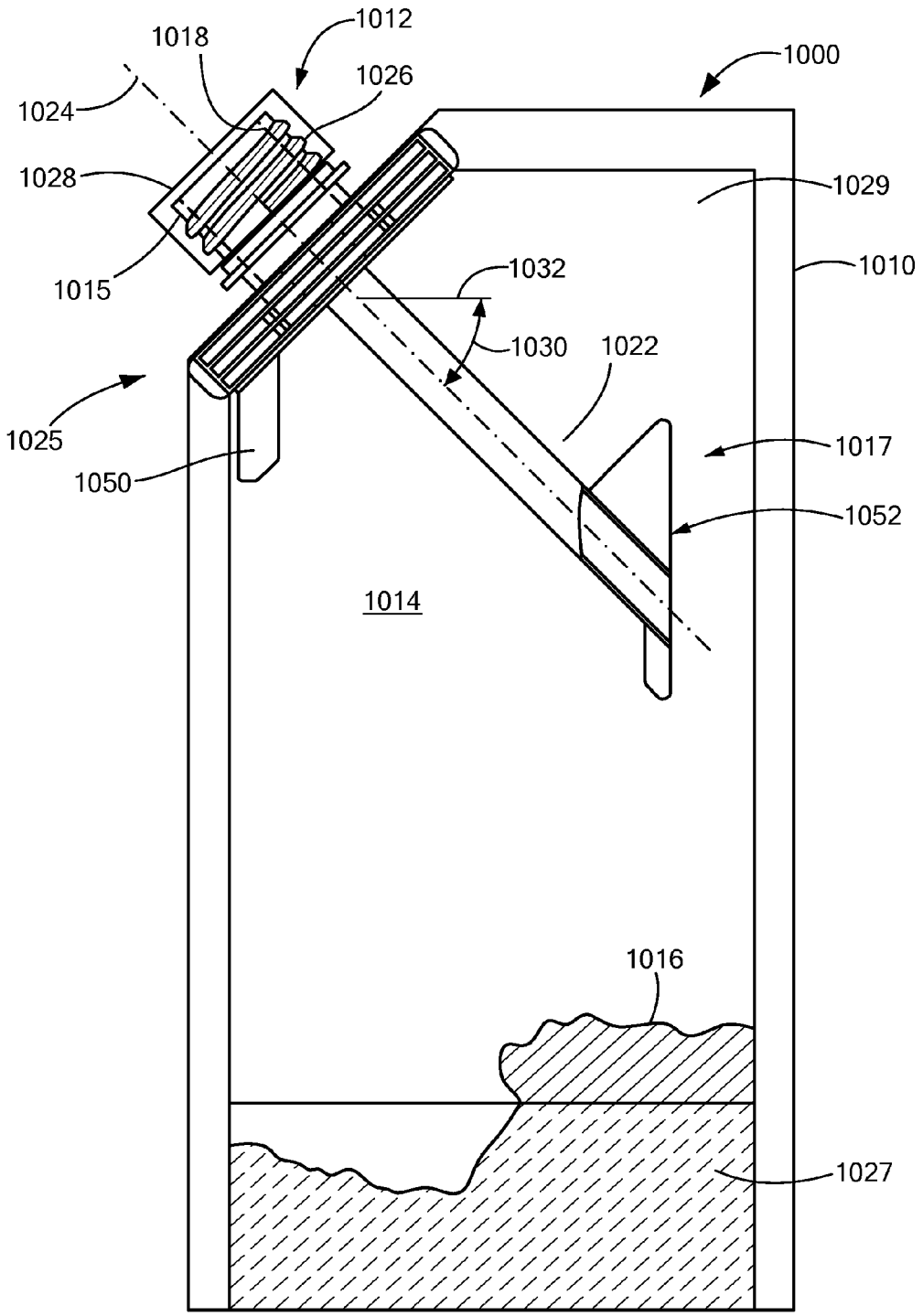
FIG. 10 is a cut-away view of a container having an insert assembly, according to another embodiment of the present invention.

FIG. 10 illustrates an example of a container assembly 1000, in partial sectional view, that includes a container 1010 and an insert assembly 1012. The container 1010, as illustrated, is configured as a bag or pouch. For example, the pouch can be manufactured from a flexible or compliant material, such as a thin plastic film material, or foil film. Insert assembly 1012 includes a mounting element 1013, a grasping assembly 1017, a spout element 1015 carried by the mounting element 1013, and a flow-through structure 1022 carried by the mounting element 1013 and disposed in fluid communication with the spout element 1015.

Figure 19:
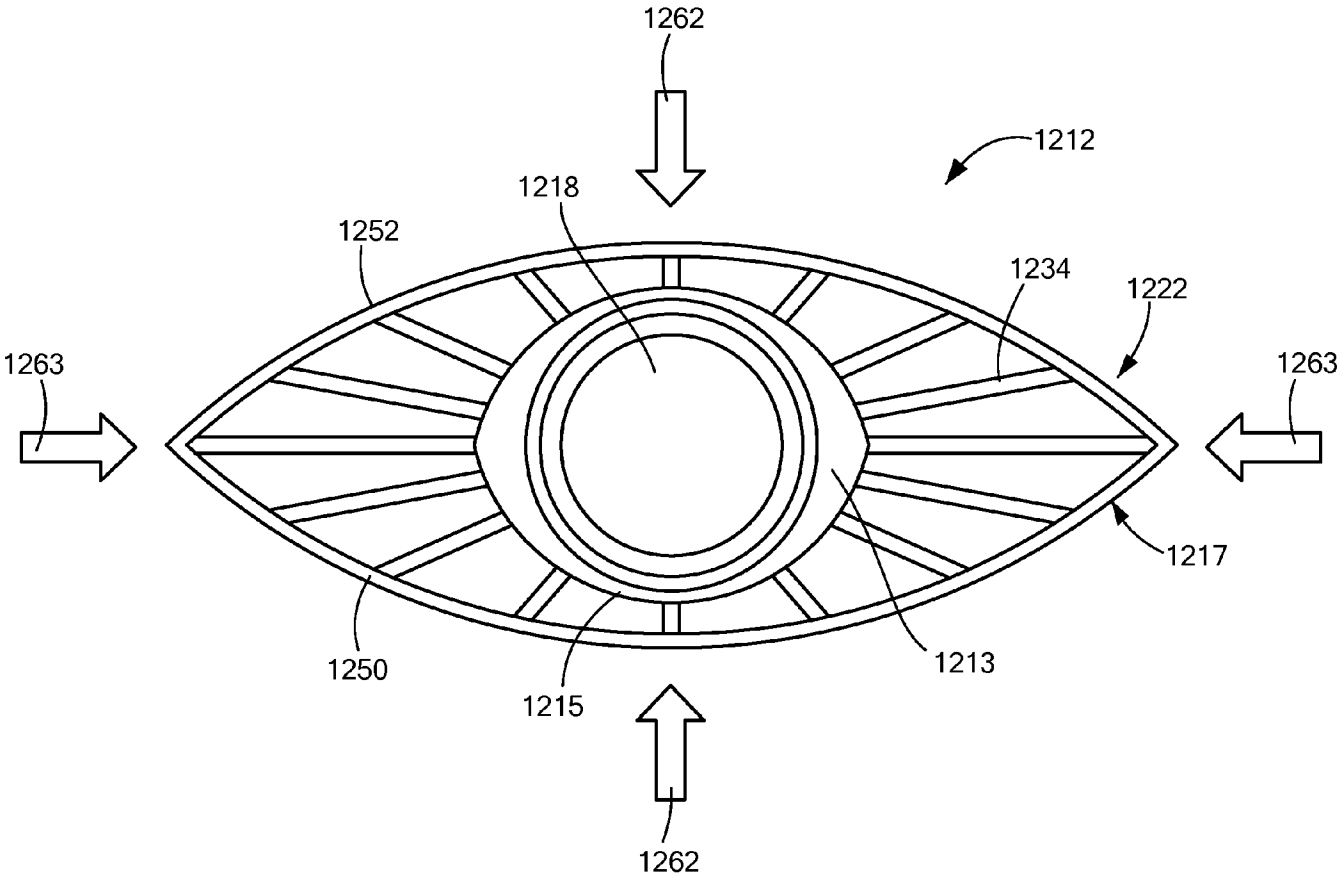
FIG. 19 is a top view of the insert assembly of FIG. 16.
Figure 21:
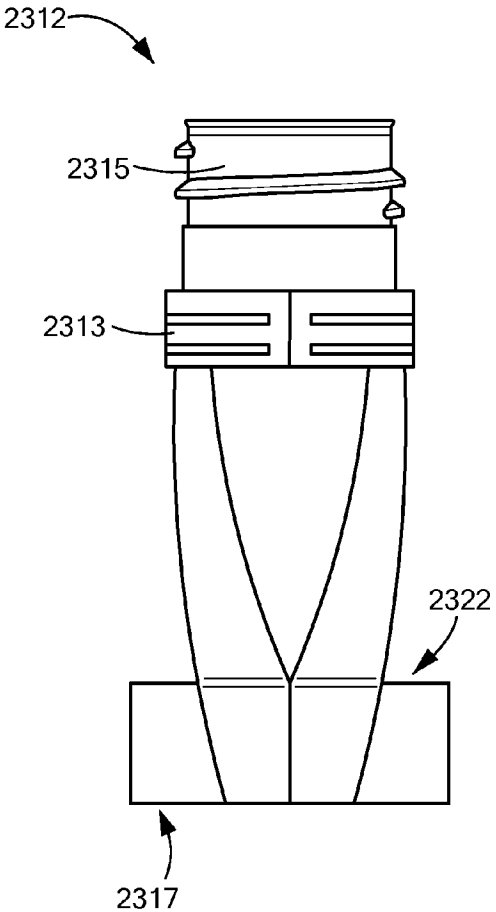
FIG. 21 is a side view of the insert assembly of FIG. 20.
Figure 20:
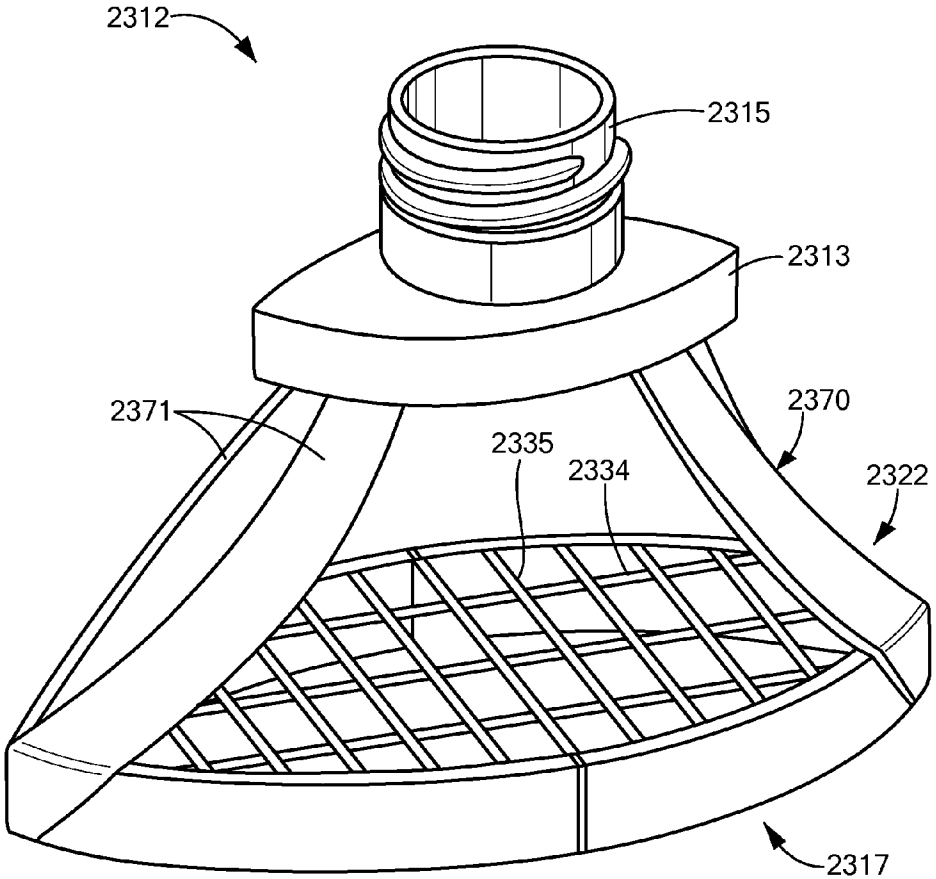
FIG. 20 is a perspective view of an insert assembly, according to another embodiment of the present invention.
Figure 22:
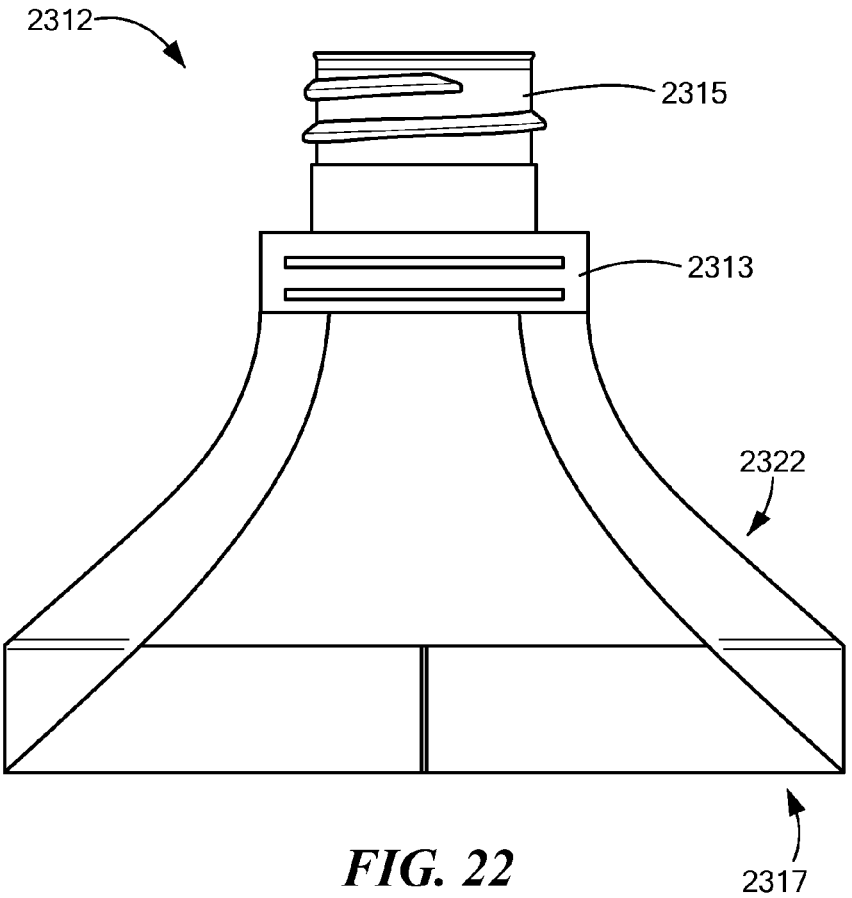
FIG. 22 is a front view of the insert assembly of FIG. 20.
Figure 23:
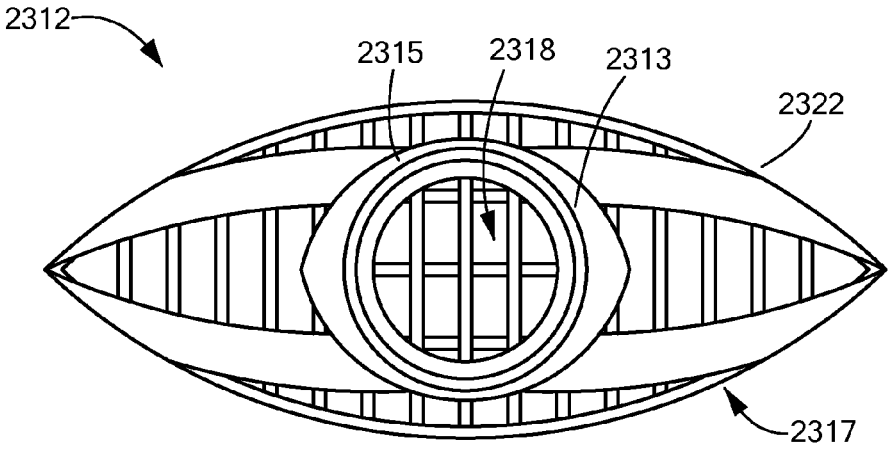
FIG. 23 is a top view of the insert assembly of FIG. 20.
Figure 24:
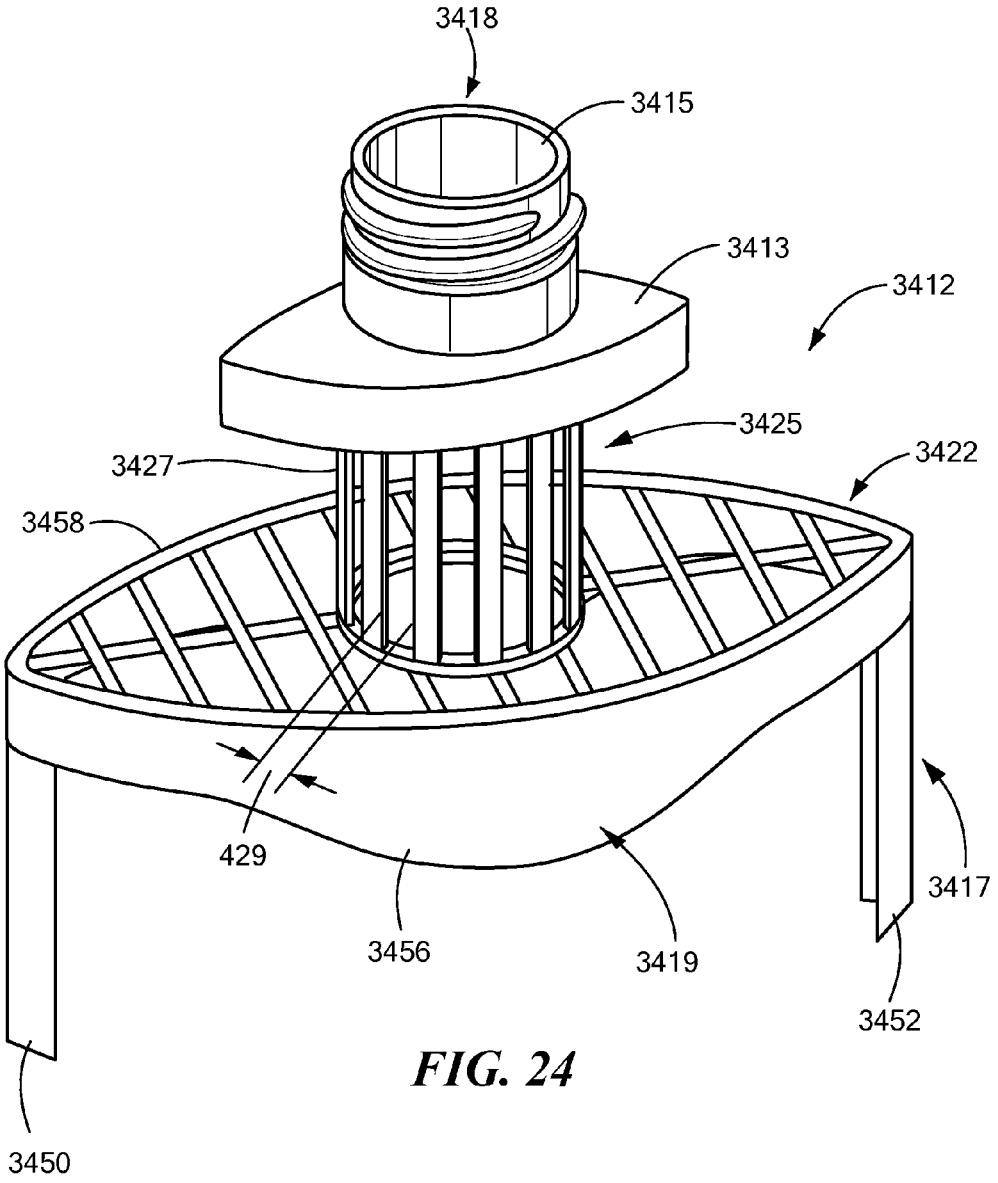
FIG. 24 is a perspective view of an insert assembly, according to another embodiment of the present invention.
Figure 25:
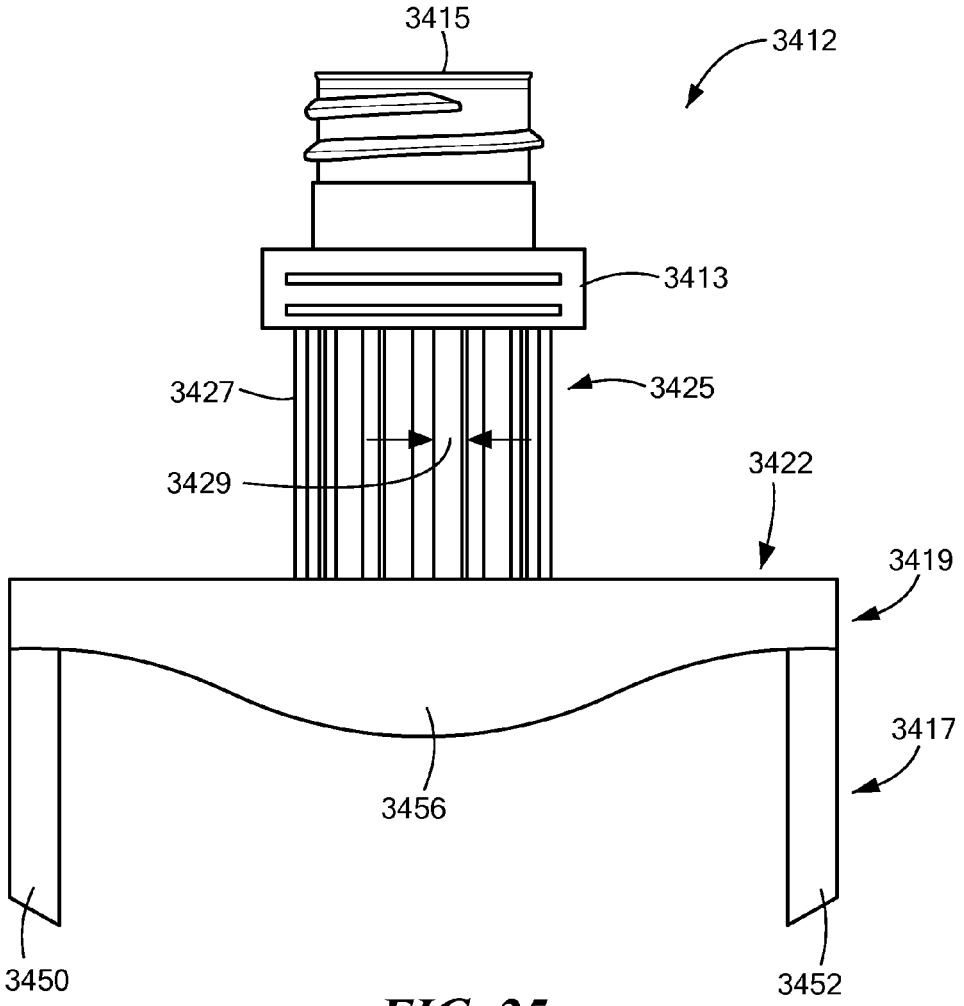
FIG. 25 is a front view of the insert assembly of FIG. 24.
Figure 27:
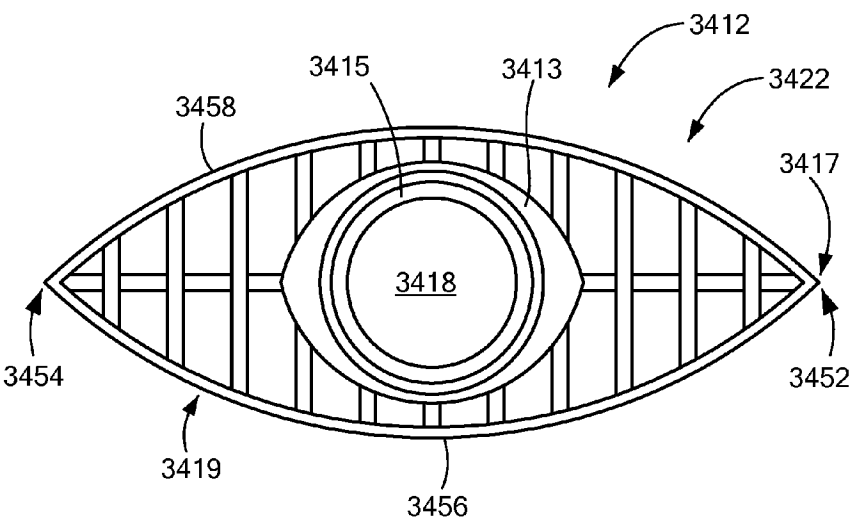
FIG. 27 is a top view of the insert assembly of FIG. 24.
Figure 26:
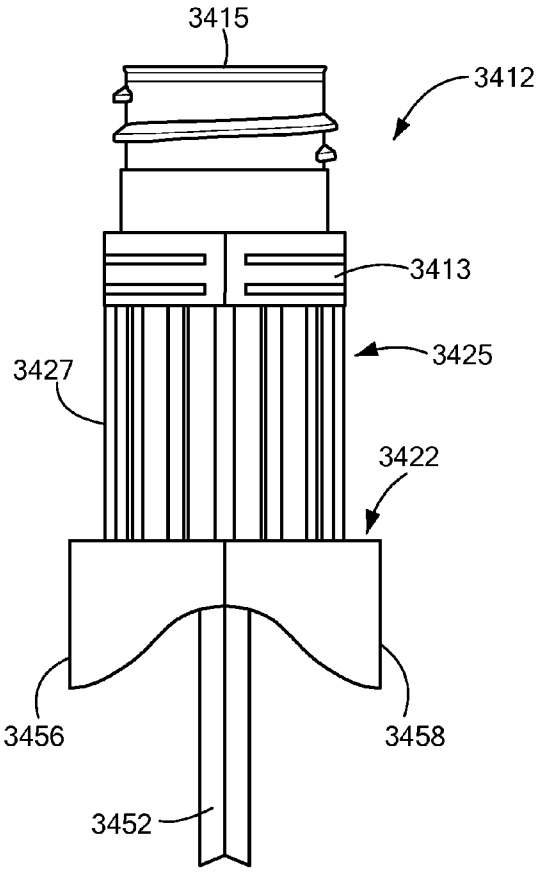
FIG. 26 is a side view of the insert assembly of FIG. 24.

The mounting element 1013 is configured to be coupled to the container 1010. For example, as illustrated in FIG. 10, the mounting element 1013 is disposed at a corner 1025 of the container 1010. In one arrangement, the mounting element 1013 is configured to maintain a distance between, or separation of, at least a portion of the lateral walls of the container 1010, namely a first wall 1027 and an opposing second wall 1029. For example, when the container 1010 is configured as a pouch formed of a compliant material, the mounting element 1013 maintains a separation between the walls 1027, 1029 of the container 1010 at least in proximity to the mounting element. Such separation allows the walls 1027 and 1029 to define the volume 1014 within the container 1010 and to allow a user to readily and easily introduce fluid into the container 1010. While the mounting element 1013 can be configured as a wedge or diamond shape, as indicated in FIG. 19, it should be noted that the mounting element 1013 can be configured in a variety of other shapes as well.

The grasping assembly 1017 is configured to provide a level of rigidity to the container 1010 to allow a user to readily grasp and hold the container 1010. For example, the grasping assembly 1017 can include a first grasping element 1050 extending longitudinally from the mounting element 1013 and a second grasping element 1052 extending longitudinally from a distal portion of the flow-through structure 1022. In use, a user can grasp the container 1010 along a direction that is substantially parallel to walls 1027 and 1029 to engage the first and second grasping elements 1050 and 1052.

The spout element 1015 is configured to allow fluid to both enter and exit the volume 1014 of the container 1010. For example, the spout element 1015 defines an opening 1018 that extends along a longitudinal axis 1024 of the insert assembly 1012 between a location outside of the container 1010 and the volume 1014 defined by the container 1010. In one arrangement, the spout element 1015 includes a set of external threads 1026 disposed about an outer perimeter of the spout element 1015. The set of threads 1026 is configured to interface with a corresponding set of complementarily-shaped internal threads of an associated cover or cap 1028. Interaction between the set of external threads 1026 on the spout element 1015 and the set of internal threads of the cover 1028 provides a releasable seal between the cover 1028 and the container 1010.

The flow-through structure 1022 extends from the mounting structure 1013 into the volume 1014 defined by the container 1010. While the flow-through structure 1022 can extend into the volume 1014 in a variety of ways, in one arrangement as illustrated in FIG. 10, the flow-through structure 1022 extends substantially perpendicular to the mounting structure 1013 and at an angle 1030, such as about 45°, relative to a horizontal reference 1032 associated with the container 1010.

Figure 11:
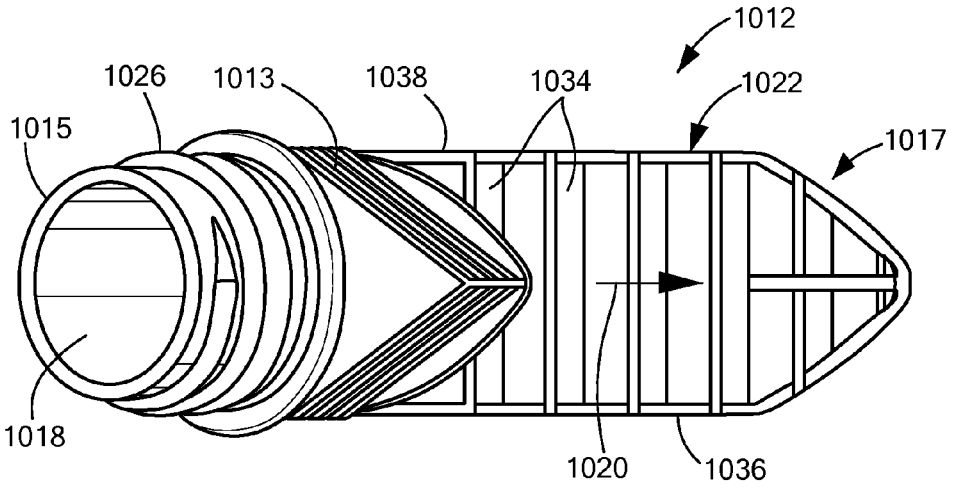
FIG. 11 is a top view of the insert assembly of FIG. 10.
Figure 12:
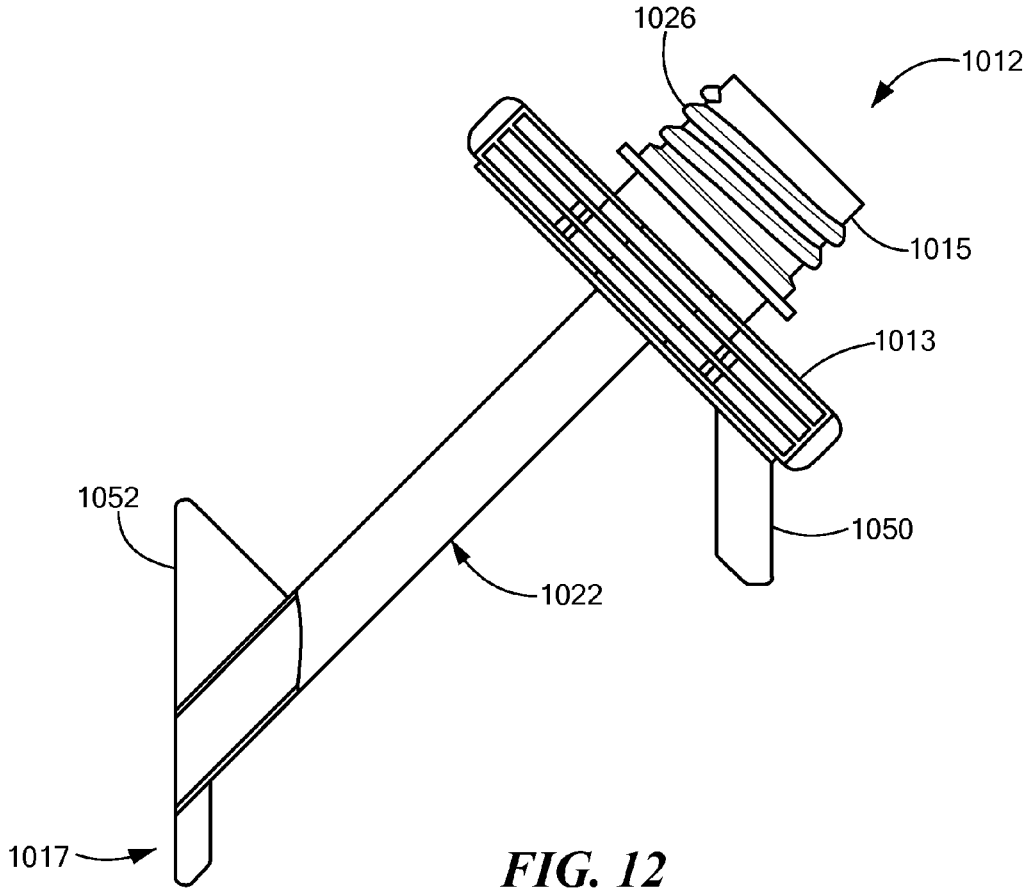
FIG. 12 is a back view of the insert assembly of FIG. 10.
Figure 13:
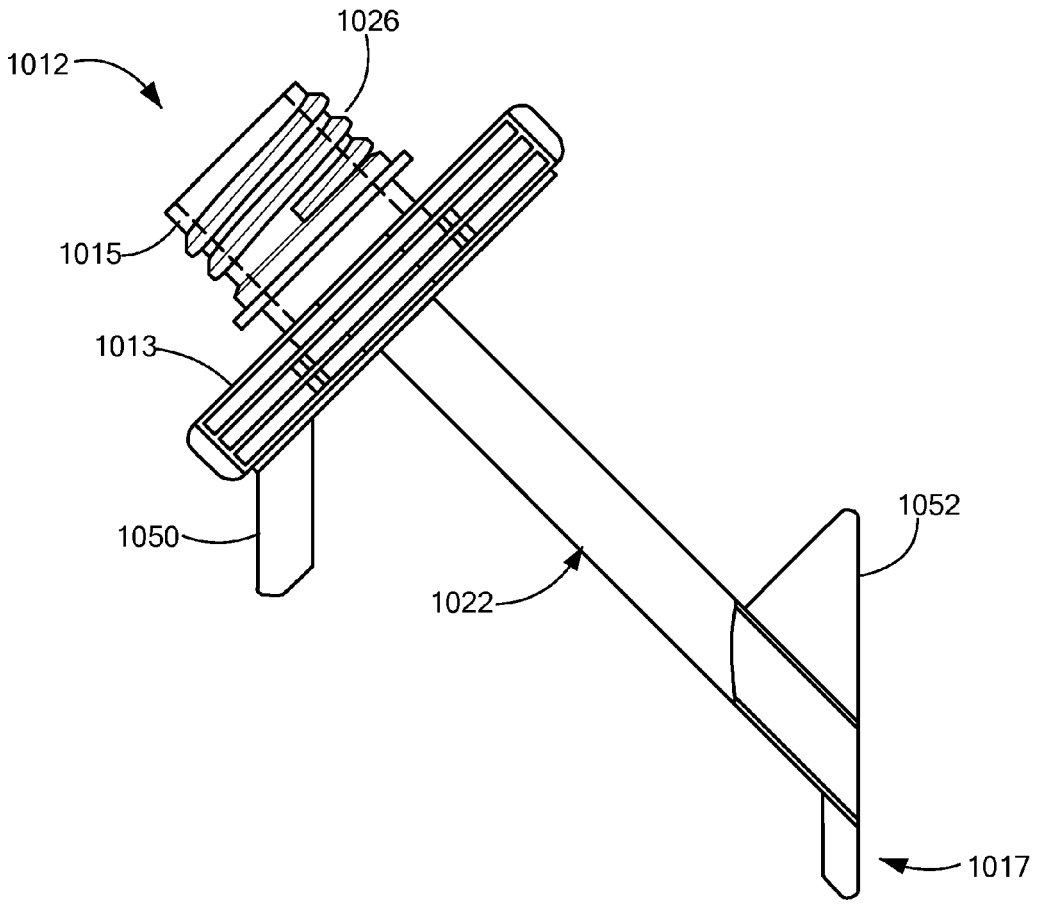
FIG. 13 is a front view of the insert assembly of FIG. 10.
Figure 15:
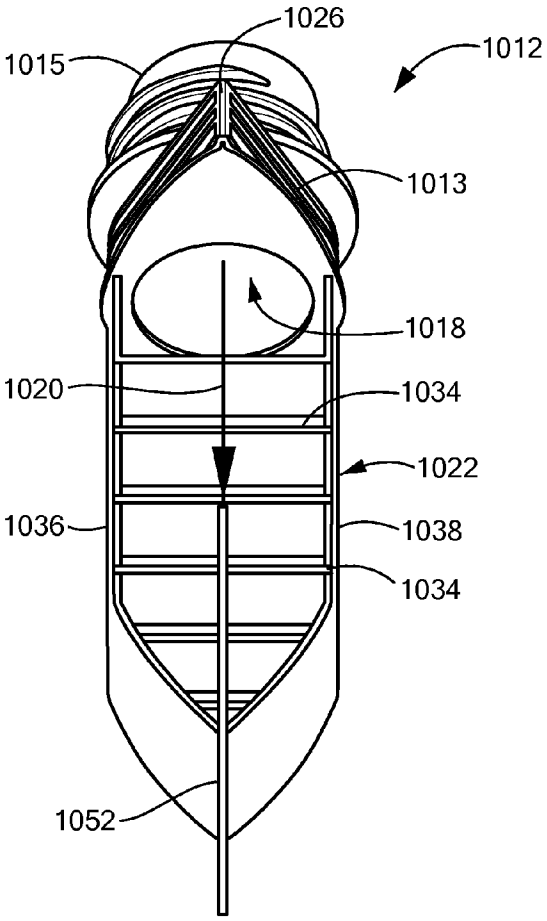
FIG. 15 is a bottom view of the insert assembly of FIG. 10.
Figure 14:
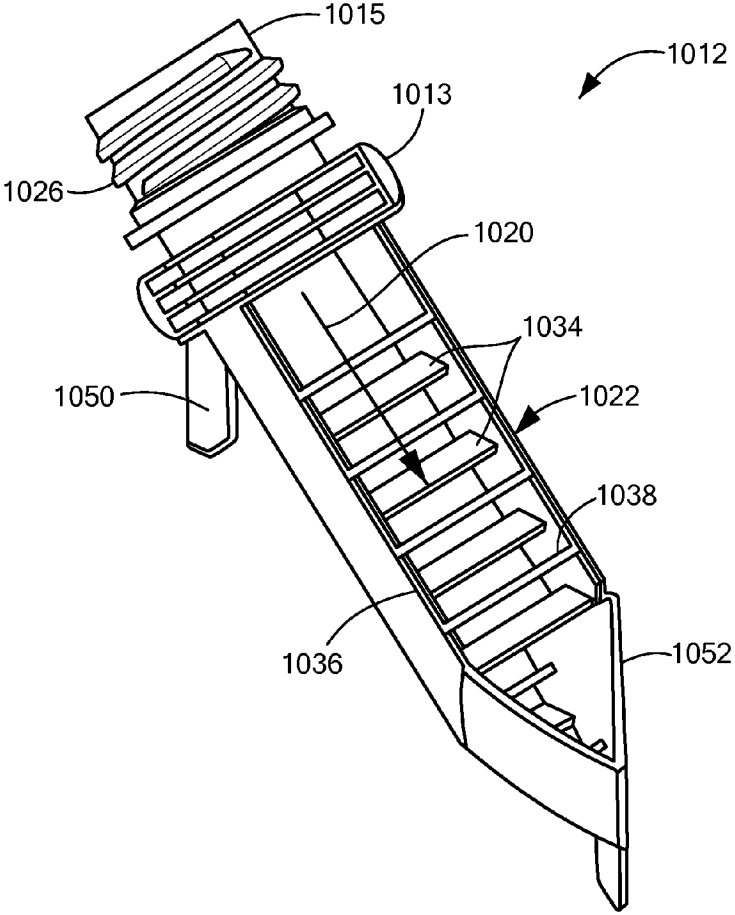
FIG. 14 is a perspective view of the insert assembly of FIG. 10.
Figure 16:
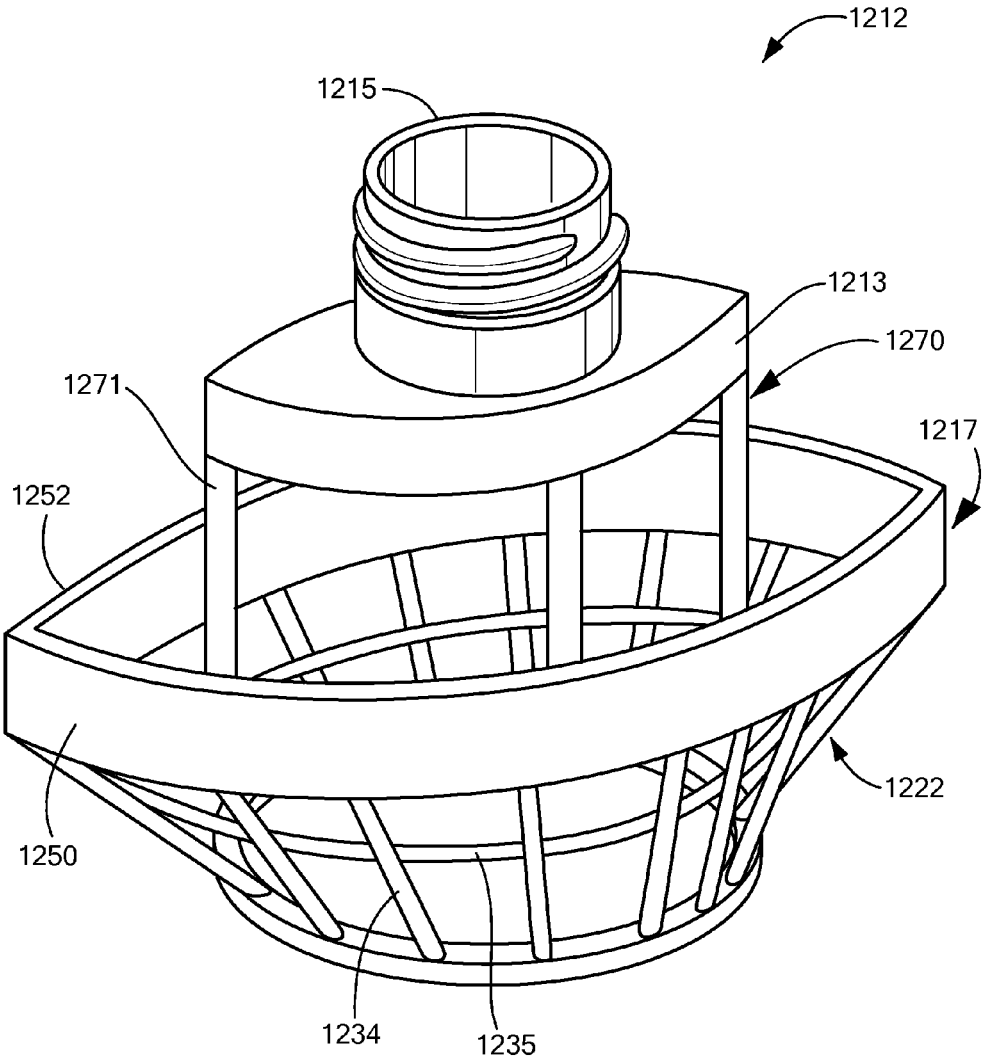
FIG. 16 is a perspective view of an insert assembly, according to another embodiment of the present invention.
Figure 17:
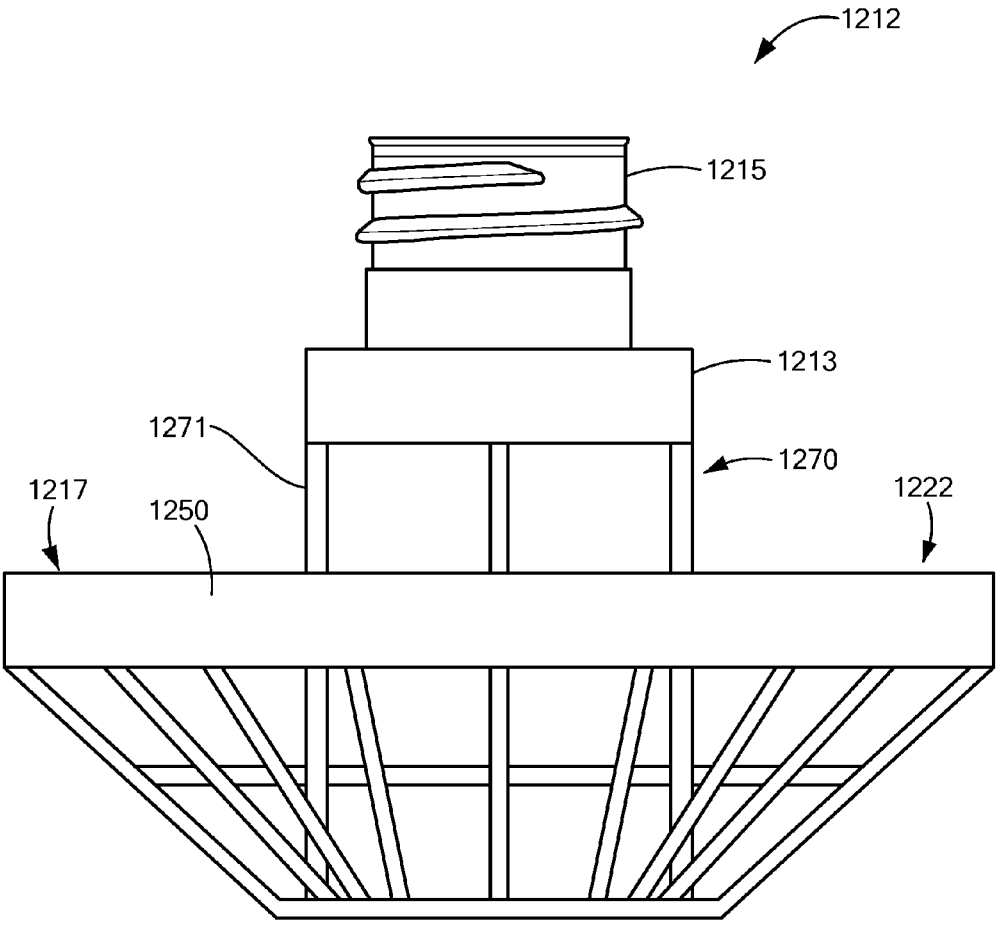
FIG. 17 is a front view of the insert assembly of FIG. 16.
Figure 18:
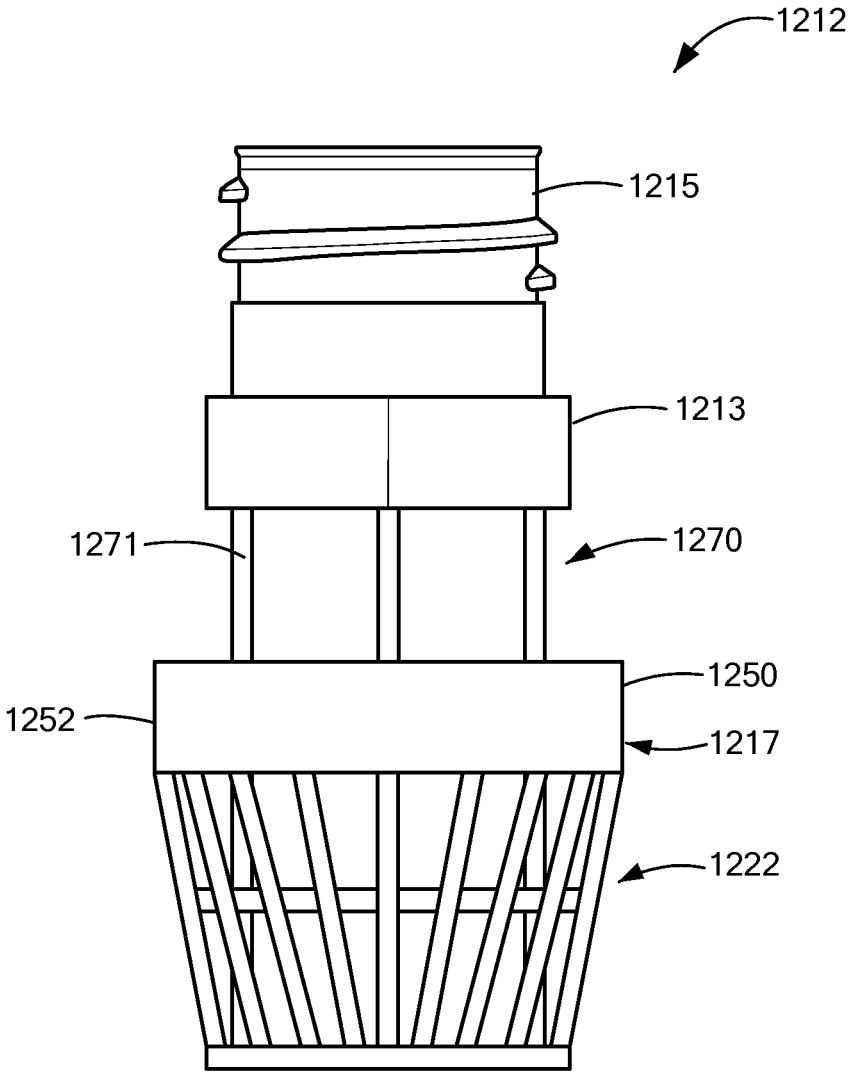
FIG. 18 is a side view of the insert assembly of FIG. 16.

As indicated above, the flow-through structure 1022 is configured to induce turbulence to fluid added to the container 1010 as the fluid flows from the spout element 1015, past the flow-through structure 1022, and to the container volume 1014. While the flow-through structure 1022 can be configured in a variety of ways, as illustrated in FIGS. 11, 14, and 15, the flow-through structure 1022 includes a series of steps or ladder elements 1034 extending between a first and second support 1036 and 1038, respectively. As shown, the step elements 1034 are disposed at substantially a 90° angle relative to a flow direction of a fluid 1020 entering the container 1010. As the fluid 1020 contacts the series of step elements 1034, the step elements 1034 impinge upon at least a portion of the flow of the fluid 1020 to create turbulence within the fluid stream. As the turbulent fluid contacts the powdered material 1016 disposed within the volume, the turbulence causes mixing of the fluid with the powdered material 1016.

Based upon the configuration of the flow-through structure 1022, the insert provides substantially automatic mixing of the fluid 1020 and a powdered material 1016 disposed within a container 1010.

FIGS. 16-19 illustrate another embodiment of an insert assembly 1212 for a container. For example, the insert assembly 1212 includes a mounting element 1213, a grasping assembly 1217, a spout element 1215 carried by the mounting element 1213, and a flow-through structure 1222 carried by the mounting element 1213 and disposed in fluid communication with the spout element 1215.

The grasping assembly 1217 is configured to provide a level of rigidity to an associated container to allow a user to readily grasp and hold the container. For example, the grasping assembly 1217 can include a first grasping element 1250 and a second grasping element 1252 disposed at a proximal end of the flow-through structure 1222. In use, in the case where the container is configured as a pouch, a user can grasp, as schematically indicated by arrows 1262 (FIG. 19), the associated container along direction that is perpendicular to the walls of the pouch to engage the first and second grasping elements 1250 and 1252. In this case, the user grasps the container across a minor diameter of the grasping assembly 1217. However, alternatively, the user may grasp the container across a major diameter of the grasping assembly 1217, as indicated by arrows 1263.

As illustrated, the flow-through structure 1222 is configured as a basket structure. For example, the flow-through structure 1222 includes substantially lateral structures 1234 that extend from the grasping assembly 1217 as well as longitudinal structures 1235. With such a configuration, the lateral and longitudinal structures 1234 and 1235 are configured to impinge upon at least a portion of a flow of the fluid received via the spout element 1215 to create turbulence within the fluid.

Also as illustrated, the flow-through structure 1222 is disposed at a distance from the mounting structure 1213 by a support structure 1270. For example, the support structure 1270 is configured as a set of supports 1271 that extend longitudinally from the mounting structure 1213 and that couple to a distal end of the flow-through structure 1222. Further, the flow-through structure 1222 can be disposed within a container at a variety of distances from a top or upper surface of the container. For example, in one arrangement, the flow-through structure 1222 is disposed from the top surface of the container at a distance of approximately ⅓ a total length of the container. Such positioning can optimize mixing of a fluid introduced to the container with a powdered material carried therein.

FIGS. 20-23 illustrate another embodiment of an insert assembly 2312 for a container. The insert assembly 2312 includes a mounting element 2313, a grasping assembly 2317, a spout element 2315 carried by the mounting element 2313, and a flow-through structure 2322 carried by the mounting element 2313 and disposed in fluid communication with the spout element 2315.

As illustrated, the flow-through structure 2322 is configured as a grid or mesh structure. For example, the flow-through structure 2322 includes substantially lateral structures 2334 and longitudinal structures 2335 that extend within the grasping assembly 2317. With such a configuration, the lateral and longitudinal structures 2334 and 2335 are configured to impinge upon at least a portion of a flow of the fluid received via the spout element 315 to create turbulence within the fluid.

The flow-through structure 2322 is disposed at a distance from the mounting structure 2313 by a support structure 2370. For example, the support structure 2370 is configured as a set of flared supports 2371 that extend longitudinally from the mounting structure 2313 and that couple to the grasping assembly 2317. Further, the flow-through structure 2322 can be disposed within a container at a variety of distances from a top or upper surface of the container. For example, in one arrangement the flow-through structure 2322 is disposed from the top surface of the container at a distance of approximately ⅓ a total length of the container.

As indicated above, when a user adds fluid to a container via an insert assembly, the fluid contacts an associated flow-through structure which creates turbulence within the fluid stream and causes mixing of the fluid with powdered material carried within the container. However, in certain cases the powdered material may not completely mix with the fluid introduced to the container. As a result, the resulting mixture can include clumps of non-dissolved powder that can be consumed by the user. To minimize the delivery of clumps of non-dissolved powder to the user, in one arrangement, the insert assembly includes a particle filter configured to limit or prevent the clumps from entering the spout element of an associated insert assembly.

For example, FIGS. 24-27 illustrate another arrangement of an insert assembly 3412 for a container where the insert assembly 3412 includes a particle filter 3425. While the particle filter 3425 can be configured in a variety of ways, in one arrangement, the particle filter 3425 is configured as a set of slat elements 3427 extending laterally between a mounting structure 3413 and a flow-through structure 3422. In one arrangement, the slat elements 3427 define a substantially tube-shaped structure substantially aligned with an opening 3418 of an associated spout element 3415. While the set of slat element 3427 can be disposed at a variety of relative spacings, in one arrangement, each slat element is disposed at a distance 3429 (FIG. 25) of about 3 mm form each other. With such spacing, the particle filter 3425 can limit or prevent delivery of clumps of non-dissolved powder to the user.

With continued reference to FIGS. 24-27, the insert assembly is configured with a first grasping assembly 3417 and a second grasping assembly 3419. For example, the first grasping assembly 3417 extends substantially longitudinally from the flow-through structure 3422 and includes opposing first and second grasping elements 3450 and 3452. Further, the second grasping assembly 3419 also extends substantially longitudinally from the flow-through structure 3422 and includes opposing first and second grasping elements 3456 and 3458. With such a configuration, a user can grasp an associated container along an axis that is parallel to the walls of the container to engage the first and second grasping elements 3450 and 3452 or along an axis that is perpendicular to the walls of the container to engage the first and second grasping elements 3456 and 3458.

Figure 28:
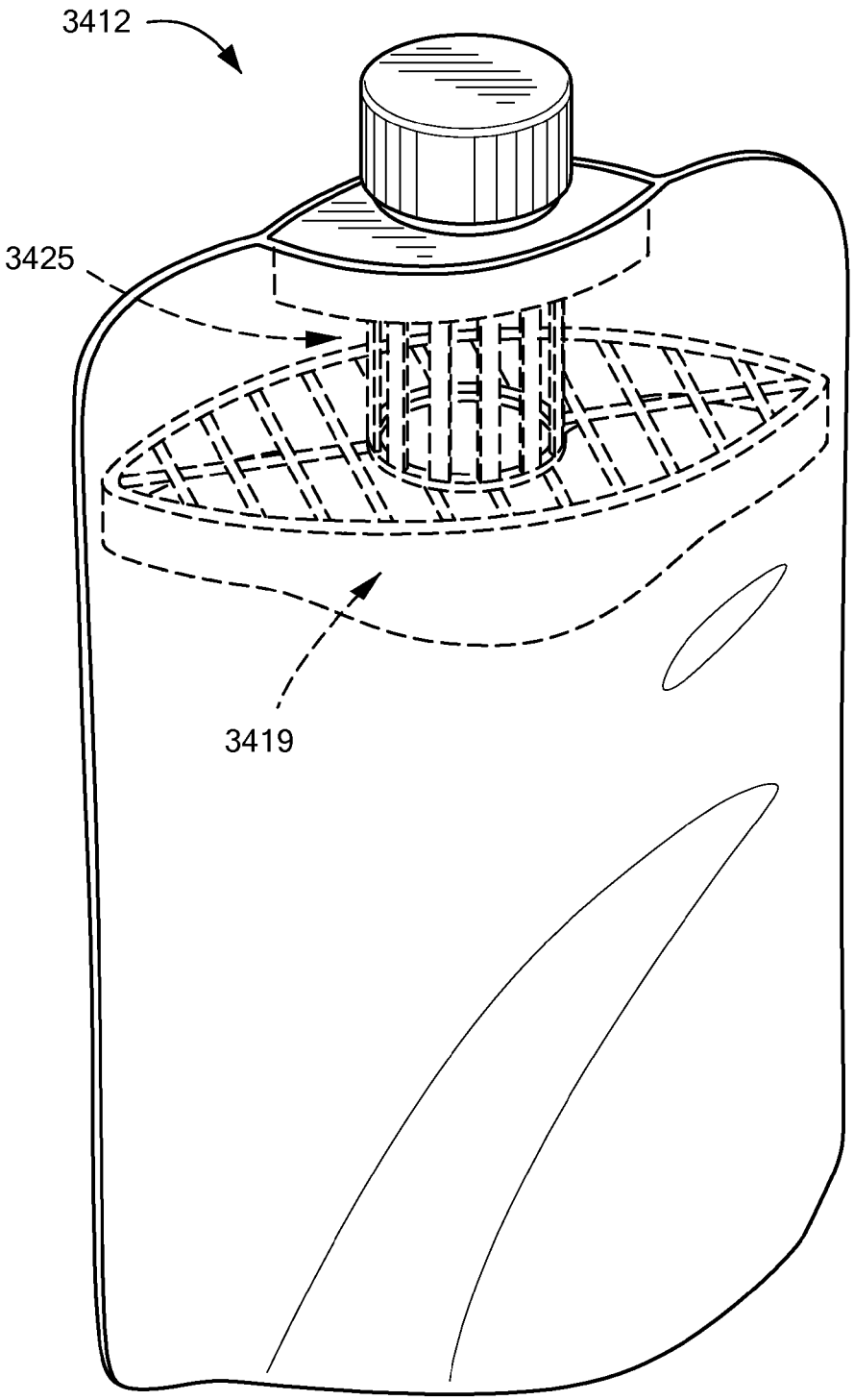
FIG. 28 is a side view of a container having an insert assembly, according to another embodiment of the present invention.
Figure 29:
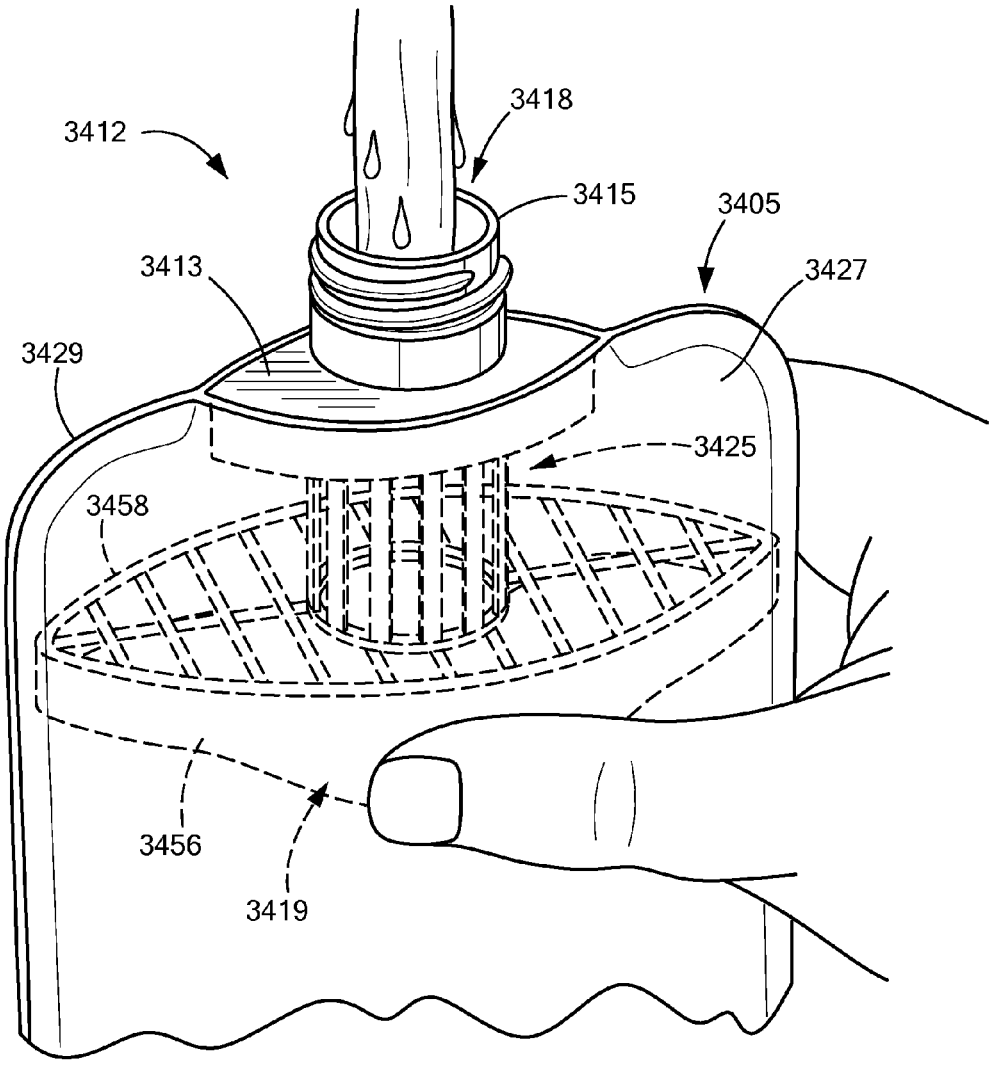
FIG. 29 is a view of the container of FIG. 28 receiving fluid via the insert assembly.
Figure 31:
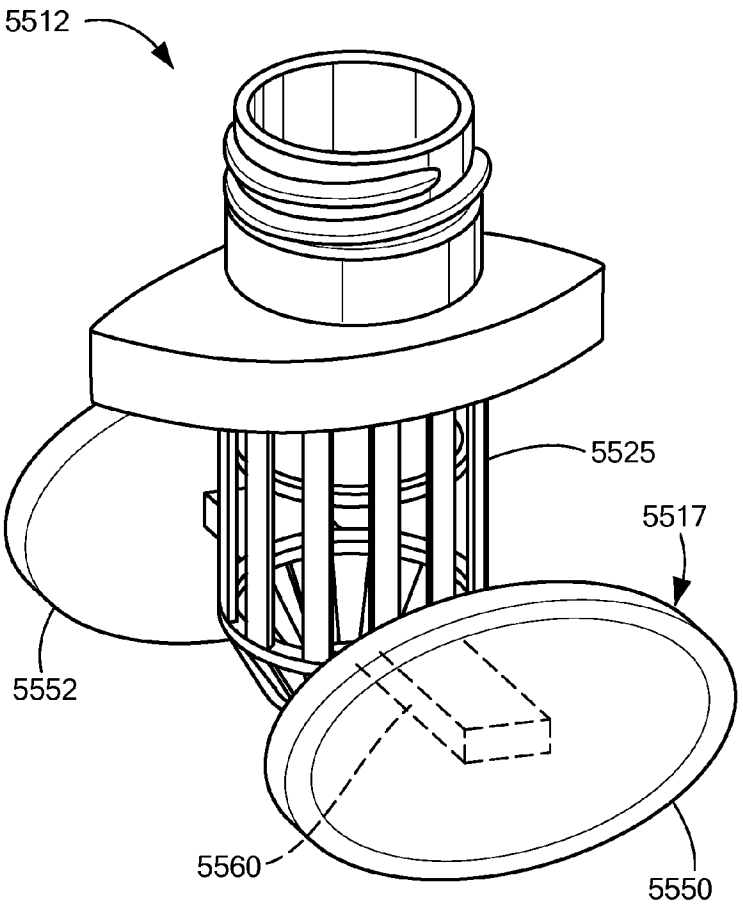
FIG. 31 is a perspective view of a variation of the insert assembly of FIG. 30.

While FIGS. 24-27 illustrate the insert assembly 3412 as including both first and second grasping assemblies 3417 and 3419, such illustration is by way of example only. In one embodiment, as illustrated in FIG. 28, the insert assembly 3412 includes only the second grasping assembly 3419. As shown in FIG. 29, with such a configuration, the user can grasp the associated container 3405 along an axis that is parallel to the walls to engage the first and second grasping elements 3450 and 3452 or along an axis that is perpendicular to the walls 3427 and 3429 to engage the first and second grasping elements 3456 and 3458.

Figure 30:
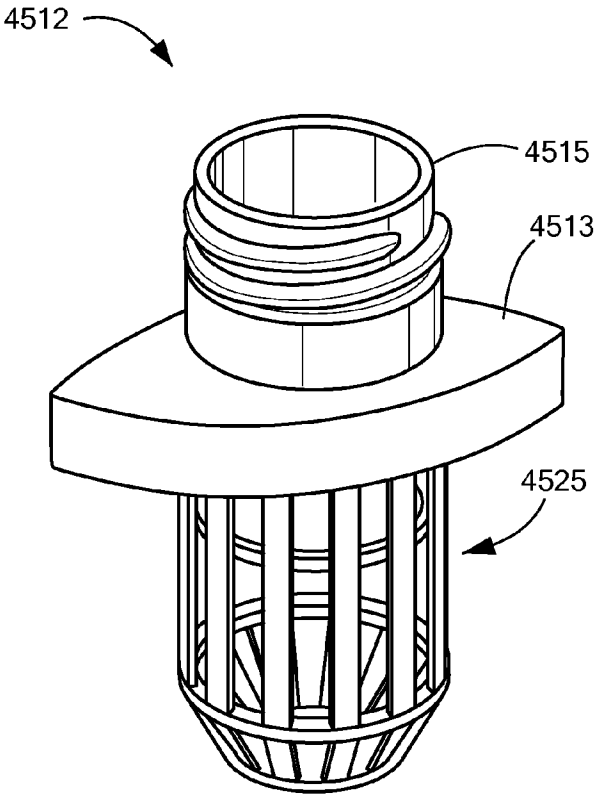
FIG. 30 is a perspective view of an insert assembly, according to another embodiment of the present invention.

While FIGS. 24-27 illustrate an arrangement of an insert assembly 3413 including both a flow-through structure 3422 and a particle filter 3425, such illustration is by way of example only. In one embodiment illustrated in FIG. 30, an insert assembly 4512 is configured as having only a particle filter 4525 extending from an associated mounting structure 4513. As described above, the particle filter 4525 is configured to limit or prevent the non-dissolved clumps of powder from entering the spout element 4515 of the insert assembly 4512.

Figure 33:
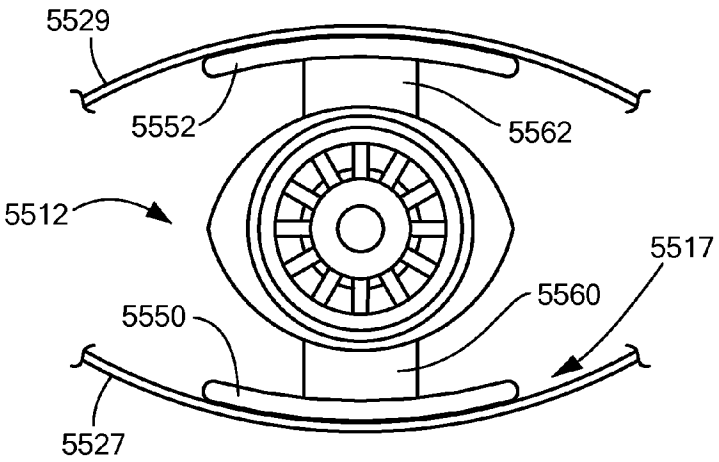
FIG. 33 is a bottom view of the insert assembly of FIG. 31.
Figure 32:
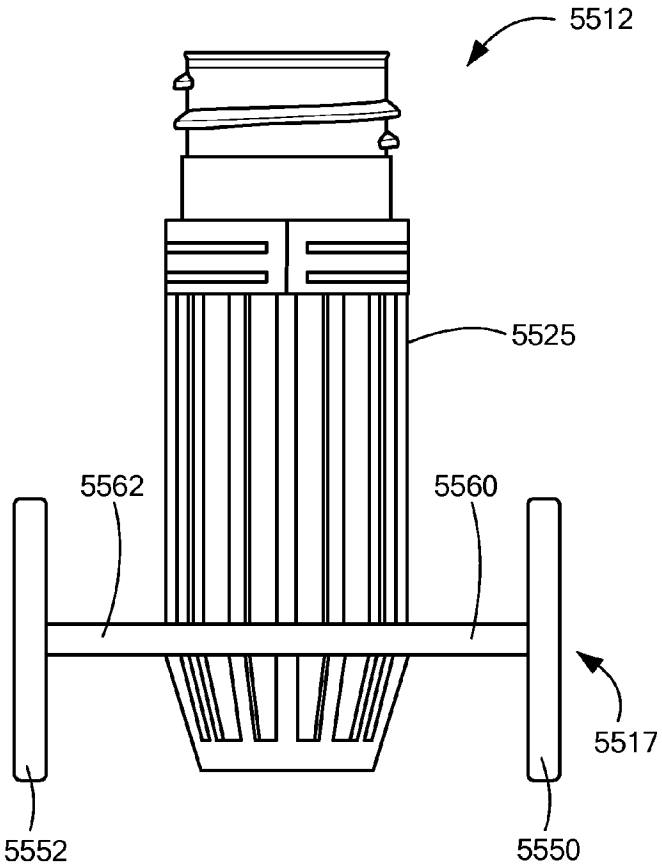
FIG. 32 is a side view of the insert assembly of FIG. 31.
Figure 34:
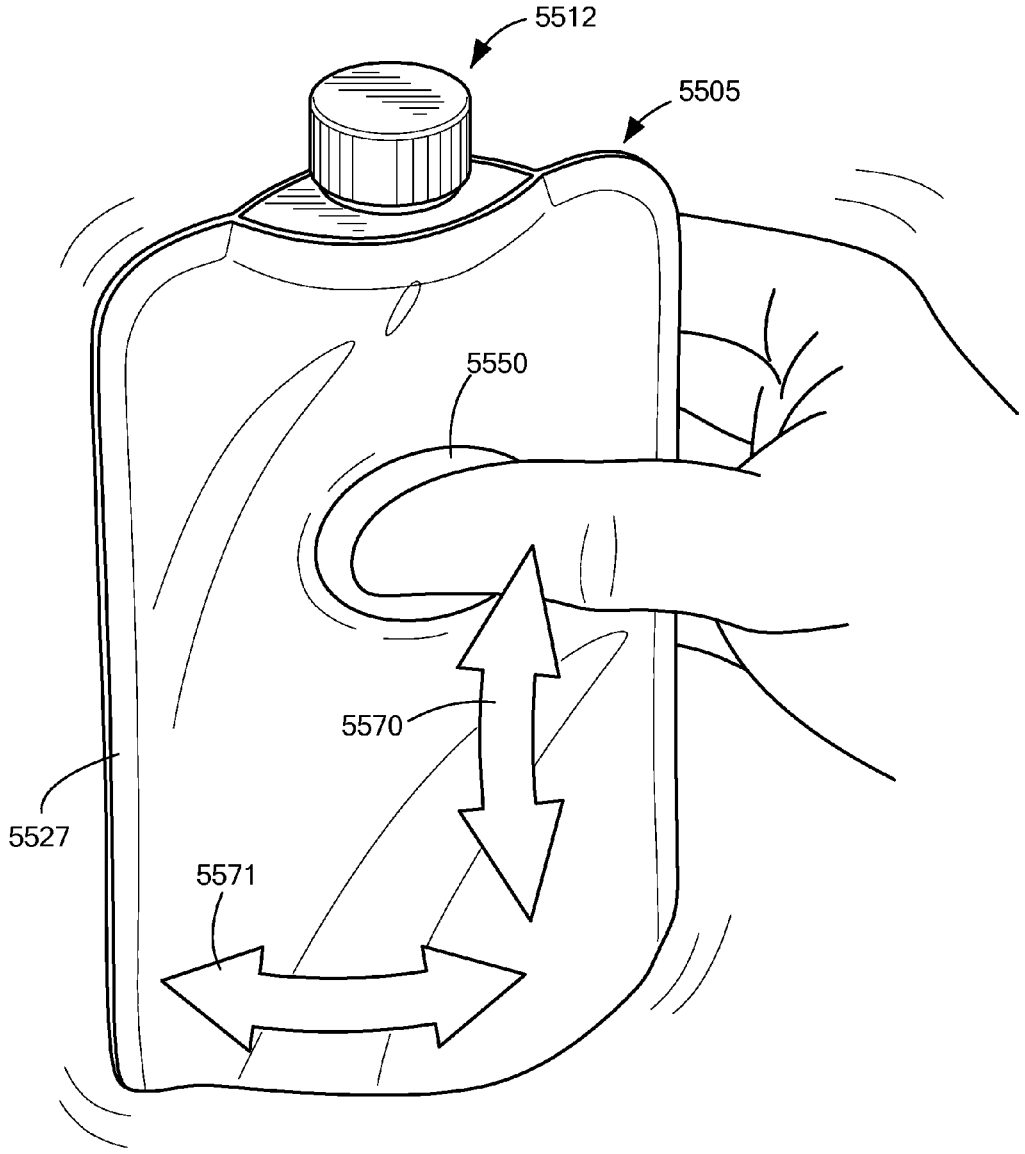
FIG. 34 is a perspective view of a container having the insert assembly of FIG. 31, according to an embodiment of the present invention.

FIGS. 31-34 illustrate an alternate embodiment of an insert assembly. As illustrated, the insert assembly 5512 includes the particle filter 5525 having a grasping assembly 5517 attached thereto. For example, the grasping assembly 5517 includes a first grasping element 5550 coupled to a distal end of the particle filter 5525 via a first arm 5560 and a second opposing grasping element 5552 coupled to the distal end of the particle filter 5525 via a second arm 5562 (FIG. 32). While the grasping elements 5550 and 5552 can be configured in a variety of ways, in one arrangement as indicated in FIG. 33, the grasping elements 5550 and 5552 are curved to substantially conform to the general curvature of the walls 5527 and 5529, respectively, of the container. In use, and with particular reference to FIG. 34, the user grasps the container 5505 via the grasping elements 5550, 5552 along a direction that is substantially perpendicular to the walls 5527, 5529 of the container 5505. The user can then add fluid to the container 5505 and shakes the container 5505 using an up-and-down or a side-to-side motion, as indicated by two-headed arrow 5570 or 5571, to mix the fluid with the powdered material carried within the container 5505.

While various embodiments of the innovation have been particularly shown and described, it will be understood by those skilled in the art that various changes in form and details may be made therein without departing from the spirit and scope of the innovation as defined by the appended claims.

For example, as indicated above, the insert assembly includes a flow-through structure configured to mix the powder and fluid when a user agitates or shakes the container. As indicated above, the flow-through structure may be configured as a ladder structure (FIGS. 11, 14, and 15) or as a mesh. Such indication is by way of example only. In one arrangement, the flow-through structure can be configured with a variety of shapes. For example, the flow-through structure can be configured as a helical shape or structure.

As indicated above, with reference to FIG. 9, the container 900 can be configured as a single serving pouch defining an internal pouch volume 914 that contains a powdered material 916, such as a powdered drink concentrate, baking product or a protein powder. It should be noted that the powdered material 916 can be added to the container 900 at any time prior to a user mixing a drink. For example, in one arrangement, the powdered material 916 can be added to the container 900 by a manufacturer prior to distribution of the container 900 to consumers. In another arrangement, after purchasing an empty container 900, i.e. without powdered material 916, the user can add powdered concentrate to the container 900 prior to or after adding fluid.

In another embodiment, the container 900 is prefilled by a manufacturer with liquid, and a user can then add power and mix the combination prior to consuming or otherwise using the mixture.

In another embodiment, the container 900 includes two or more burstable compartments that are not in fluid communication with each other. Each compartment may contain a different liquid or powder. A user can then squeeze the container 900 to rupture one or more internal walls separating the compartments, thereby allowing the contents of the compartments to be mixed, such as by shaking the container 900.

Figure 35:
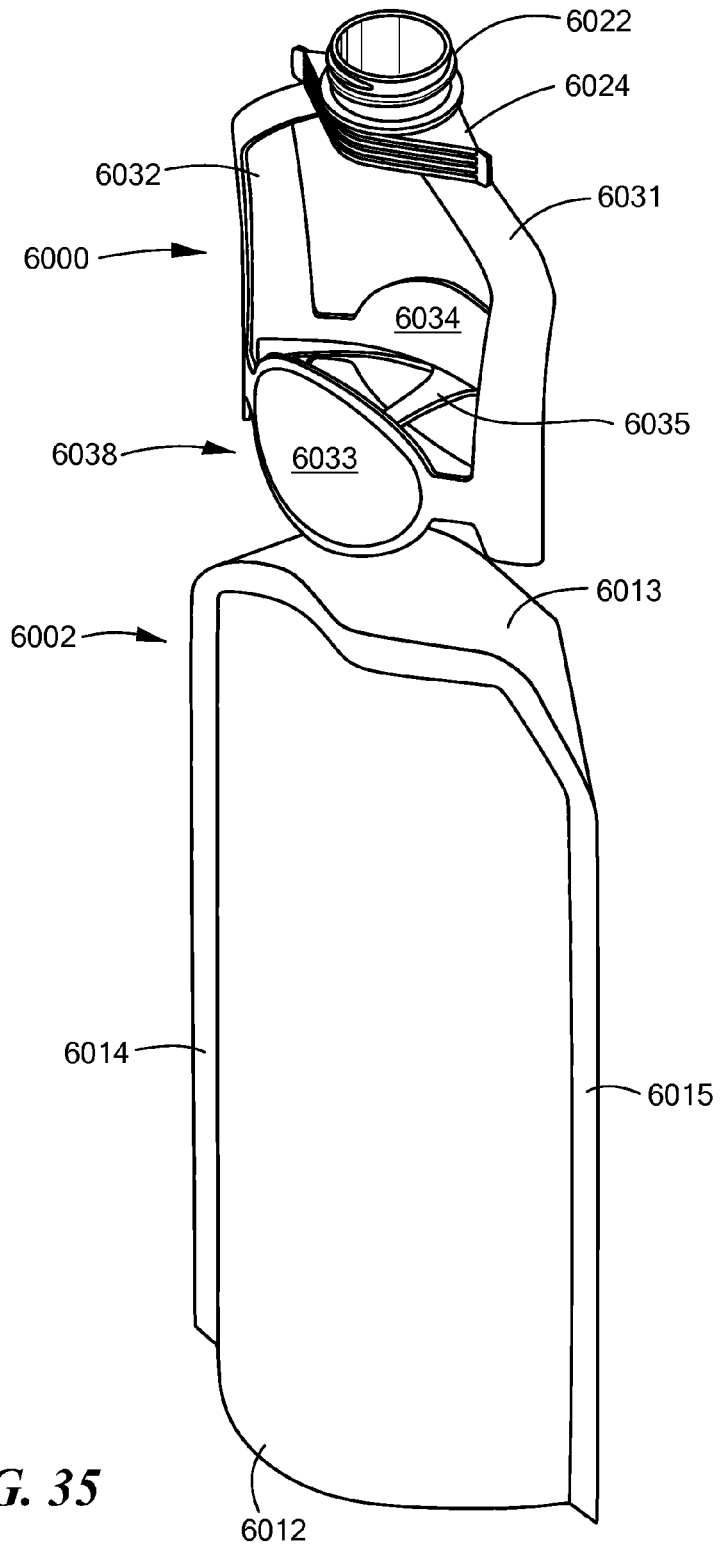
FIG. 35 is a perspective exploded view of an insert assembly and a flexible container, according to another embodiment of the present invention.

FIG. 35 is a perspective exploded view of an insert assembly 6000 and a flexible container 6002, according to another embodiment of the present invention. The container 6002 includes a gusseted or fixed-shape portion 6012, which facilitates defining an interior 6013 of the container 6002. Front and rear walls of the container 6002 are welded along sides 6014 and 6015 of the container. The insert assembly 6000 includes a spout 6022, a mounting structure 6024 and support structures 6031 and 6031 attached to the mounting structure 6024. A grasp structure 6038 is attached to the support structures 6031 and 6032. The grasp structure 6038 includes an oval or canoe-shaped loop, as discussed with other embodiments, as well as two pads 6033 and 6034. A spacing member 6035 extends between the two pads 6033 and 6034 to resist collapse of the pads 6033 and 6034 toward each other when a user grasps the container 6002.

Figure 36:
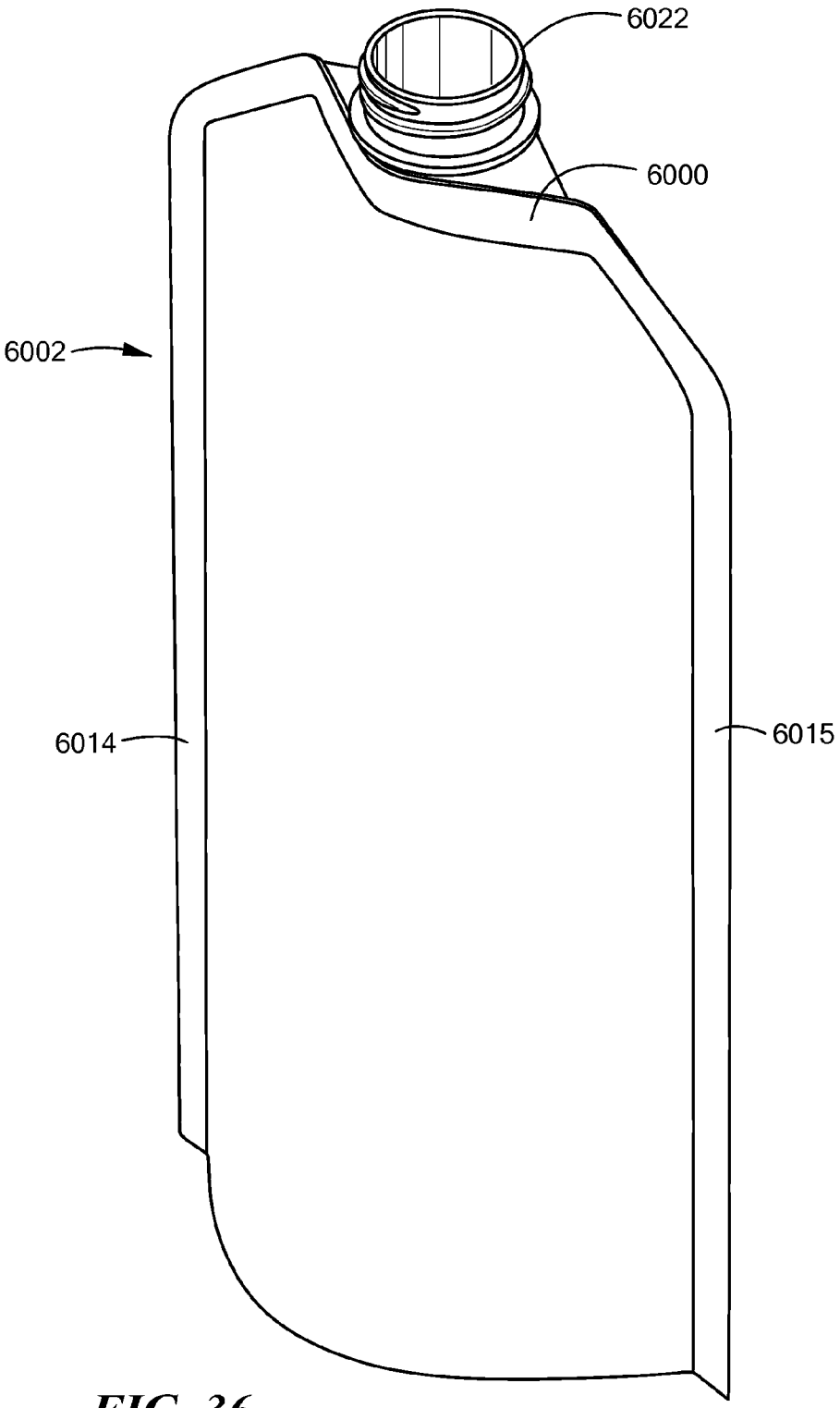
FIG. 36 is a perspective view of the insert assembly and a flexible container of FIG. 35.
Figure 37:
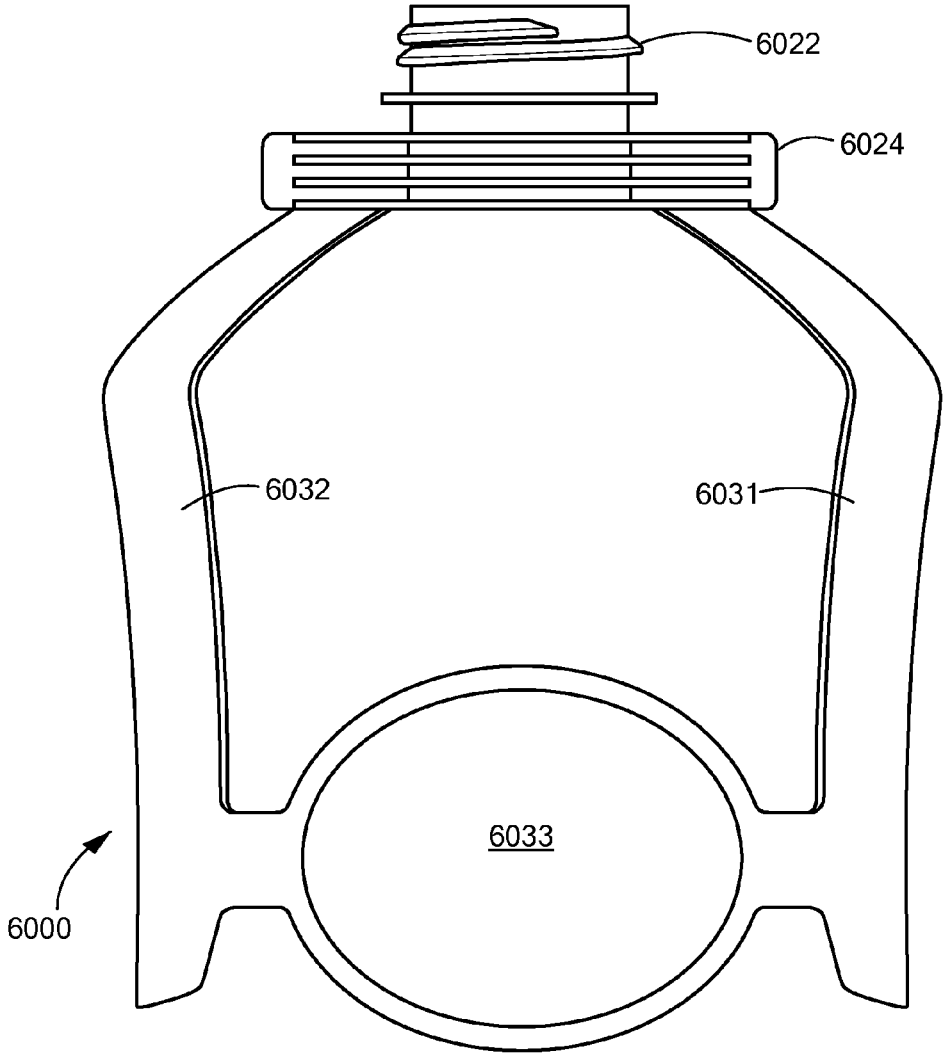
FIG. 37 is a side view of the insert assembly of FIGS. 35 and 36.

FIG. 36 is a perspective view of the insert assembly 6000 and the flexible container 6002 after the insert assembly 6000 has been installed in the flexible container 6002. The insert assembly 6000 is sealingly attached to the flexible container 6002, as indicated at 3600. FIG. 37 is a side view of the insert assembly 3500.

Figure 39:
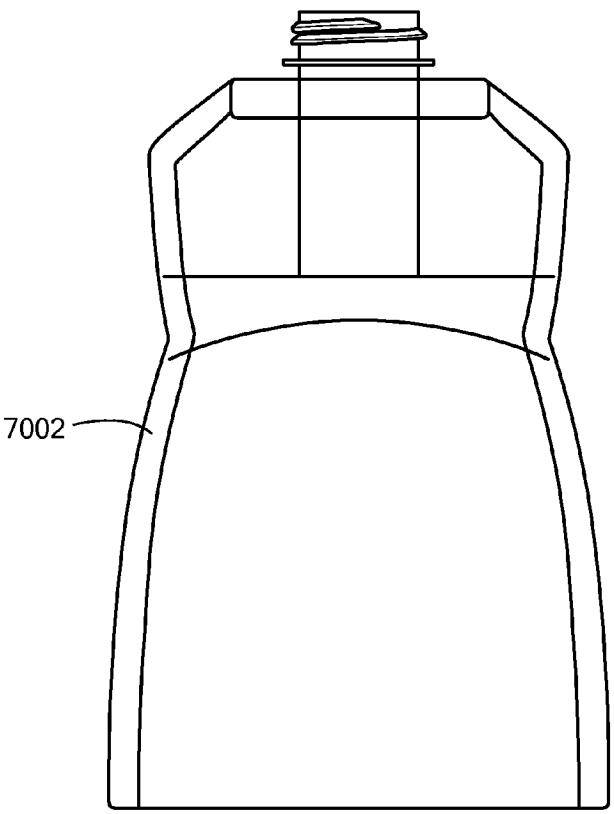
FIG. 39 is a front view of the insert assembly in the flexible container of FIG. 38.
Figure 38:
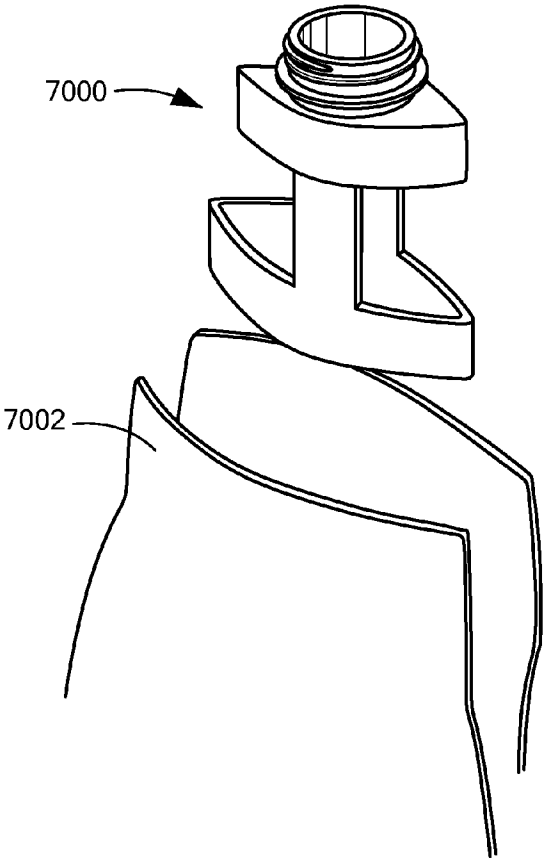
FIG. 38 is a perspective exploded view of an insert assembly and a flexible container, according to another embodiment of the present invention.

FIG. 38 is a perspective exploded view of an insert assembly 7000 and a flexible container 7002, according to another embodiment of the present invention. FIG. 39 is a front view of the insert assembly in the flexible container of FIG. 38.

While the invention is described through the above-described exemplary embodiments, it will be understood by those of ordinary skill in the art that modifications to, and variations of, the illustrated embodiments may be made without departing from the inventive concepts disclosed herein. While specific values chosen for these embodiments are recited, it is to be understood that, within the scope of the invention, the values of all of parameters may vary over wide ranges to suit different applications. Furthermore, disclosed aspects, or portions of these aspects, may be combined in ways not listed above. Accordingly, the invention should not be viewed as being limited to the disclosed embodiments.

What is claimed is:

1. A fitment for a flexible container, the flexible container having walls and defining an opening, the fitment comprising:

a mounting structure configured to be sealingly coupled to the flexible container about the opening, thereby defining an interior of the flexible container;

a spout coupled to the mounting structure, the spout defining a fluid channel through the mounting structure and configured to be in fluid communication with the interior of the flexible container;

at least one support structure extending from the mounting structure, generally parallel to an axis extending through the fluid channel of the spout, the at least one support structure being configured to extend into the interior of the flexible container; and a grasp structure extending along a closed loop in a plane generally perpendicular to the axis passing through the fluid channel of the spout, the grasp structure being attached to each of the at least one support structure and configured to be inserted into the interior of the flexible container and there extend proximate an entire inside perimeter of the flexible container, whereby the grasp structure provides a skeletal structure against which the walls of the flexible container may be pressed when the flexible container is grasped; and a mixing structure:

mechanically coupled to the first support structure, the second support structure and the grasp structure;

configured to extend into the interior of the flexible container; and disposed so as to promote mixing of contents in the interior of the flexible container.

2. A fitment according to claim 1, further comprising a first spacing member extending from a first point along the grasp structure to an approximately diametrically opposite point along the grasp structure, the first spacing member not being directly attached to the mounting structure.

3. A fitment according to claim 2, wherein the first spacing member extends generally along an arc in a plane generally perpendicular to the plane of the loop.

4. A fitment according to claim 3, further comprising:

a first pad attached to the grasp structure proximate the first point along the grasp structure and oriented generally parallel to the axis passing through the fluid channel of the spout; and a second pad generally parallel to the first pad and attached to the grasp structure proximate the diametrically opposite point along the grasp structure.

5. A fitment according to claim 4, wherein:

the at least one support structure comprises at least a first support structure and a second support structure;

the first support structure is attached to the grasp structure approximately equidistantly between the first point along the grasp structure and the diametrically opposite point along the grasp structure; and the second support structure is attached to the grasp structure approximately diametrically opposite the first support structure.

6. A fitment according to claim 5, further comprising a second spacing member extending from where the first support structure is attached to the grasp structure to where the second support structure is attached to the grasp structure, the second spacing member not being directly attached to the mounting structure.

7. A fitment according to claim 6, wherein the second spacing member extends generally along an arc in a plane generally perpendicular to the plane of the first spacing member.

8. A fitment according to claim 7, wherein each of the first support structure and the second support structure defines an outwardly-facing concave portion proximate where the respective support structure is attached to the grasp structure.

9. A fitment according to claim 1, wherein the grasp structure extends along a generally oval-shaped loop having a major diameter at least about 1½ times as long as a minor diameter of the generally oval-shaped loop.

10. A fitment according to claim 1, wherein:

the flexible container has a predetermined internal depth; and the mounting structure, the at least one support structure and the grasp structure are configured such that the grasp structure is spaced from the mounting structure along the axis of the fluid channel of the spout a distance of between about ¼ and about ¾ the internal depth of the flexible container.

11. A fitment according to claim 1, wherein:

the flexible container defines a waist portion located a predetermined distance from the opening of the flexible container; and the mounting structure, the at least one support structure and the grasp structure are configured such that the grasp structure is spaced from the mounting structure along the axis of the fluid channel of the spout a distance approximately equal to the predetermined distance.

12. A fitment according to claim 11, further comprising the flexible container.

13. A fitment according to claim 1, further comprising a mixing structure:

mechanically coupled to the mounting structure;

configured to be disposed in the interior of the flexible container; and disposed so as to promote mixing of contents in the interior of the flexible container.

14. A fitment according to claim 13, wherein the mixing structure comprises a plurality of interconnected members collectively defining a plurality of apertures through the mixing structure.

15. A fitment for a flexible container, the flexible container having walls and defining an opening, the fitment comprising:

a mounting structure configured to be sealingly coupled to the flexible container about the opening, thereby defining an interior of the flexible container;

a spout coupled to the mounting structure, the spout defining a fluid channel through the mounting structure and configured to be in fluid communication with the interior of the flexible container;

at least one support structure extending from the mounting structure, generally parallel to an axis extending through the fluid channel of the spout, the at least one support structure being configured to extend into the interior of the flexible container; and a mixing structure attached to the at least one support structure, the mixing structure comprising a closed loop in a plane generally perpendicular to the axis passing through the fluid channel of the spout, the mixing structure being configured to be disposed in the interior of the flexible container and disposed so as to promote mixing of contents in the interior of the flexible container.

16. A fitment according to claim 15, wherein the mixing structure comprises a plurality of interconnected members collectively defining a plurality of apertures through the mixing structure.

17. A fitment according to claim 15, wherein:

the flexible container has a predetermined internal depth; and the mounting structure, the at least one support structure and the mixing structure are configured such that the mixing structure is spaced from the mounting structure along the axis of the fluid channel of the spout a distance of between about ¼ and about ¾ the internal depth of the flexible container.

18. A fitment according to claim 15, wherein:

the flexible container defines a waist portion located a predetermined distance from the opening of the flexible container; and the mounting structure, the at least one support structure and the mixing structure are configured such that the mixing structure is spaced from the mounting structure along the axis of the fluid channel of the spout a distance approximately equal to the predetermined distance.

19. A fitment according to claim 18, further comprising the flexible container.

* * * * *